US011618257B2

(12) United States Patent
Lee et al.

(10) Patent No.: US 11,618,257 B2
(45) Date of Patent: Apr. 4, 2023

(54) INKJET PRINTING APPARATUS AND INKJET PRINTING METHOD USING THE SAME

(71) Applicant: Samsung Display Co., LTD., Yongin-si (KR)

(72) Inventors: Seon Uk Lee, Seongnam-si (KR); Kang Soo Han, Seoul (KR); Che Ho Lim, Cheonan-si (KR); Don Chan Cho, Seongnam-si (KR); Hak Bum Choi, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 79 days.

(21) Appl. No.: 17/190,367

(22) Filed: Mar. 2, 2021

(65) Prior Publication Data

US 2022/0024208 A1 Jan. 27, 2022

(30) Foreign Application Priority Data

Jul. 22, 2020 (KR) ..... 10-2020-0090812

(51) Int. Cl.
*B41J 2/14* (2006.01)

(52) U.S. Cl.
CPC ..... *B41J 2/1433* (2013.01); *B41J 2/14201* (2013.01)

(58) Field of Classification Search
CPC ... B41J 2/1433; B41J 2/14201; B41J 2/14233
See application file for complete search history.

(56) References Cited

FOREIGN PATENT DOCUMENTS

| | | | | |
|---|---|---|---|---|
| EP | 1652674 A2 * | 5/2006 | ..... | B41J 2/09 |
| JP | 2010-108618 | 5/2010 | | |
| JP | 5599419 | 10/2014 | | |
| KR | 10-0973614 | 8/2010 | | |

OTHER PUBLICATIONS

IP.com search (Year: 2022).*

* cited by examiner

*Primary Examiner* — Lisa Solomon
(74) *Attorney, Agent, or Firm* — H.C. Park & Associates, PLC

(57) ABSTRACT

An inkjet printing apparatus includes: a passage plate in which a head chamber is disposed; and a plurality of nozzle plates disposed below the passage plate, the plurality of nozzle plates comprising a nozzle that is in fluid connection with the head chamber. The plurality of nozzle plates are stacked on each other, and the nozzle of the plurality of nozzle plates comprises a plurality of through holes passing through the plurality of nozzle plates and overlapping each other.

20 Claims, 23 Drawing Sheets

PT_2: PT11_2, PT12_2, PT13_2, PT1n_2,
PT21_2, PT22_2, PT23_2, PT2n_2,

PT_3: PT11_3, PT12_3, PT13_3, PT14_4,
PT21_3, PT22_3, PT23_3, PT24_3

INKJET PRINTING APPARATUS AND INKJET PRINTING METHOD USING THE SAME

CROSS-REFERENCE TO RELATED APPLICATION

This application claims priority from and the benefit of Korean Patent Application No. 10-2020-0090812, filed on Jul. 22, 2020, which is hereby incorporated by reference for all purposes as if fully set forth herein.

BACKGROUND

Field

Embodiments of the invention relate generally to an inkjet printing apparatus and an inkjet printing method using the same and, more specifically, to an inkjet printing apparatus having a head unit with stacked nozzle plates and an inkjet printing method using the same.

Discussion of the Background

An inkjet printing process is a technique that implements an image with colored ink by spraying the ink into predetermined areas partitioned by a partition wall. Recently, the inkjet printing process has been widely used in a manufacturing process of a display device such as an organic light emitting display (OLED) device and a liquid crystal display (LCD) device. When a pattern of the display device is printed by the inkjet printing process, elements can be produced with only a small amount of material compared to a deposition process, and the cost can be greatly reduced due to simplification of the manufacturing process.

However, when a blot or partial clogging occurs in a nozzle through which ink is ejected, the straightness of the ink may not be guaranteed and ensured, and thus the reproducibility of the ink impact position may deteriorate. In this case, a defect in which a pattern is not printed in an accurate shape may occur. In addition, productivity may be degraded due to maintenance work for removing the blot or clogging of the nozzle.

The above information disclosed in this Background section is only for understanding of the background of the inventive concepts, and, therefore, it may contain information that does not constitute prior art.

SUMMARY

Applicant discovered that when a display device is manufactured by an inkjet printing process using an inkjet printing apparatus having a head unit with a nozzle, the nozzle of the head unit of the inkjet printing apparatus may be easily clogged such that the reproducibility of the inkjet printing apparatus may be degraded and the maintenance cost of the inkjet printing apparatus may be increased.

Inkjet printing apparatuses with a head unit for manufacturing a display device constructed according to the principles and implementations of the invention are capable of improving production efficiency by increasing a replacement cycle of the head unit of the inkjet printing apparatuses. For example, the inkjet printing apparatuses includes stacked nozzle plates of the head unit, and the stacked nozzle plates can be easily repaired by detaching and removing the defective nozzle plate among the stacked nozzle plates.

Thus, the replacement time of the head unit may be shortened, thereby improving production efficiency of the inkjet printing apparatuses.

Inkjet printing methods of manufacturing the display device using inkjet printing apparatuses with a head unit according to the principles and implementations of the invention are capable of improving production efficiency by increasing a replacement cycle of the head unit of the inkjet printing apparatuses.

According to one aspect of the invention, an inkjet printing apparatus includes: a passage plate in which a head chamber is disposed; and a plurality of nozzle plates disposed below the passage plate, the plurality of nozzle plates comprising a nozzle that is in fluid connection with the head chamber, wherein: the plurality of nozzle plates are stacked on each other, and the nozzle of the plurality of nozzle plates comprises a plurality of through holes passing through the plurality of nozzle plates and overlapping each other.

Each of the plurality of nozzle plates may include a protrusion extending outwardly from a side surface of each of the plurality of nozzle plates.

A water repellent layer may be disposed on a bottom surface of each of the plurality of nozzle plates.

An adhesive layer may be disposed between the water repellent layer and the plurality of nozzle plates.

An adhesive strength between the adhesive layer and the upper surface of each of the plurality of nozzle plates may be greater than an adhesive strength between the adhesive layer and the water repellent layer.

Each of the plurality of through holes of the plurality of nozzle plates may include an upper inner side surface having a first width and a lower inner side surface having a second width smaller than the first width.

The plurality of nozzle plates may include a first nozzle plate and a second nozzle plate disposed on the first nozzle plate, and the first width of the through hole of the first nozzle plate may be greater than the first width of the through hole of the second nozzle plate.

The plurality of nozzle plates may include: a first nozzle plate; and a second nozzle plate disposed on the first nozzle plate.

The second nozzle plate may include a protrusion extending from a side surface of the second nozzle plate more outwardly than the first nozzle plate.

A first water repellent layer may be disposed on a bottom surface of the first nozzle plate, and a second water repellent layer may be disposed on a bottom surface of the second nozzle plate.

An adhesive layer may be disposed between the second water repellent layer and the first nozzle plate.

An adhesive strength between the first nozzle plate and the adhesive layer may be greater than an adhesive strength between the second water repellent layer and the adhesive layer.

A width of an inner side surface of the through hole of the first nozzle plate may be greater than a width of an inner side surface of the through hole of the second nozzle plate.

The inkjet printing apparatus may further include: a membrane disposed on the passage plate; and a piezoelectric driver disposed on the membrane and configured to change a volume of the piezoelectric driver according to an input signal, wherein the piezoelectric driver may be configured to deform the membrane.

The piezoelectric driver may be configured to change a volume of the head chamber.

Each of the plurality of nozzle plates may include a plurality of sub-nozzle plates arranged in one direction.

Each of the plurality of sub-nozzle plates may include a protrusion extending outwardly from a side surface of each of the plurality of sub-nozzle plates.

According to another aspect of the invention, an inkjet printing method includes the steps of: spraying ink using an inkjet printing apparatus including a plurality of nozzle plates, the plurality of nozzle plates including a plurality of through holes overlapping each other; determining whether a pattern of the sprayed ink is defective; removing an outermost nozzle plate among the plurality of nozzle plates when the sprayed ink pattern is defective; and spraying ink using remaining nozzle plates through the through holes of the remaining nozzle plates.

Each of the plurality of nozzle plates may include a protrusion extending outwardly from a side surface of each of the plurality of nozzle plates, and the step of removing the outermost nozzle plate may include the step of detaching the outermost nozzle plate by gripping the protrusion thereof.

The step of spraying the ink may include the step of ejecting ink through a nozzle including the plurality of through holes overlapping each other.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the inventive concepts.

DETAILED DESCRIPTION

Figure 1:
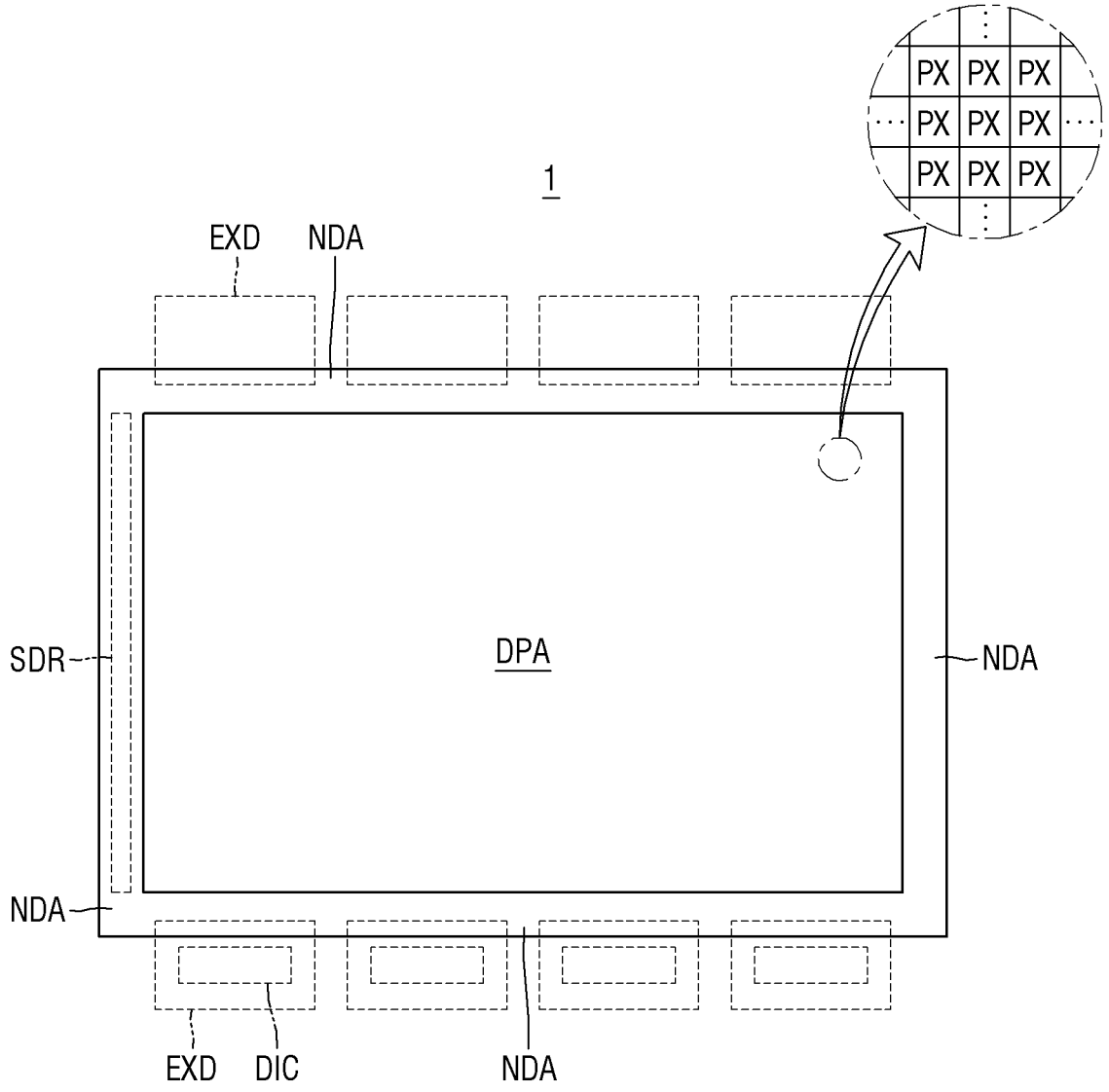
FIG. 1 is a plan view of an embodiment of a display device constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various embodiments are described herein with reference to sectional and/or exploded illustrations that are schematic illustrations of idealized embodiments and/or intermediate structures. As such, variations from the shapes of the illustrations as a result, for example, of manufacturing techniques and/or tolerances, are to be expected. Thus, embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

The same reference numbers indicate the same components throughout the specification.

Hereinafter, embodiments will be described with reference to the accompanying drawings.

FIG. 1 is a plan view of a display device according to an embodiment.

A display device 1 may refer to any electronic device with a display screen. Examples of the display device 1 may include a television, a laptop computer, a monitor, a billboard, a mobile phone, a smartphone, a tablet personal computer (PC), an electronic watch, a smart watch, a watch phone, a mobile communication terminal, an electronic notebook, an electronic book, a portable multimedia player (PMP), a navigation device, a game machine, a digital camera, an Internet-of-Things device and the like, which provide a display screen. The display device 1 illustrated in FIG. 1 is a television. The display device 1 may have a high resolution or an ultra-high resolution such as HD, UHD, 4K, and 8K. However, embodiments are not limited thereto.

The display device 1 may include various patterns for transmitting signals or changing a wavelength of light for each location. The patterns of the display device 1 are formed through a patterning process. The patterning process may include a photo process, an inkjet process, and the like. Some of the patterns may be formed by an inkjet process using an inkjet printing apparatus (e.g., 1000 of FIG. 8). The following embodiments illustrate the display device 1 in which some patterns are formed by the inkjet process.

The display device 1 may be variously classified by a display method. For example, the display device 1 may be classified into an organic light emitting display (organic LED) device, an inorganic light emitting display (inorganic LED) device, a quantum dot light emitting display (QED) device, a micro-LED display device, a nano-LED display device, a plasma display device (PDP), a field emission display (FED) device and a cathode ray tube (CRT) display device, a liquid crystal display (LCD) device, an electrophoretic display (EPD) device, and the like. Hereinafter, an organic light emitting display device will be described as an example of the display device 1, and the organic light emitting display device applied to the embodiment will be simply referred to as the display device 1 unless special distinction is required. However, embodiments are not limited thereto. For example, other display devices mentioned above or known in the art may be applied to embodiments.

Referring to FIG. 1, the display device 1 may include a display area DPA and a non-display area NDA.

The display area DPA may include a plurality of pixels PX. The plurality of pixels PX may be arranged in a matrix. The shape of each pixel PX may be rectangular or square in a plan view. However, embodiments are not limited thereto. For example, each pixel PX may have a rhombic shape of which each side is inclined with respect to one side direction of the display device 1. The pixels PX may include various color pixels PX. For example, the pixels PX may is include, a first color pixel PX of red, a second color pixel PX of green, and a third color pixel PX of blue, but embodiments are not limited thereto. The color pixels PX may be alternately arranged in a stripe type or a pentile type.

The non-display area NDA may be disposed around the display area DPA. The non-display area NDA may completely or partially surround the display area DPA. The display area DPA may have a rectangular shape, and the non-display area NDA may be disposed adjacent to four sides of the display area DPA. The non-display area NDA may form a bezel of the display device 1.

In the non-display area NDA, a driving circuit or a driving element for driving the display area DPA may be disposed. In an embodiment, pad portions disposed on a display substrate of the display device 1 may be provided in a first non-display area NDA disposed adjacent to a first long side (e.g., a lower side in FIG. 1) of the display device 1 and a second non-display area NDA disposed adjacent to a second long side (e.g., an upper side in FIG. 1) of the display device 1. External devices EXD may be mounted on pad electrodes of the pad portions. The external devices EXD may include, e.g., a connection film, a printed circuit board, a driver integrated circuit (DIC), a connector, a wire connection film and the like. A scan driver SDR directly formed on the display substrate of the display device 1 may be provided in a third non-display area NDA disposed adjacent to a first short side (e.g., a left side in FIG. 1) of the display device 1.

Figure 2:
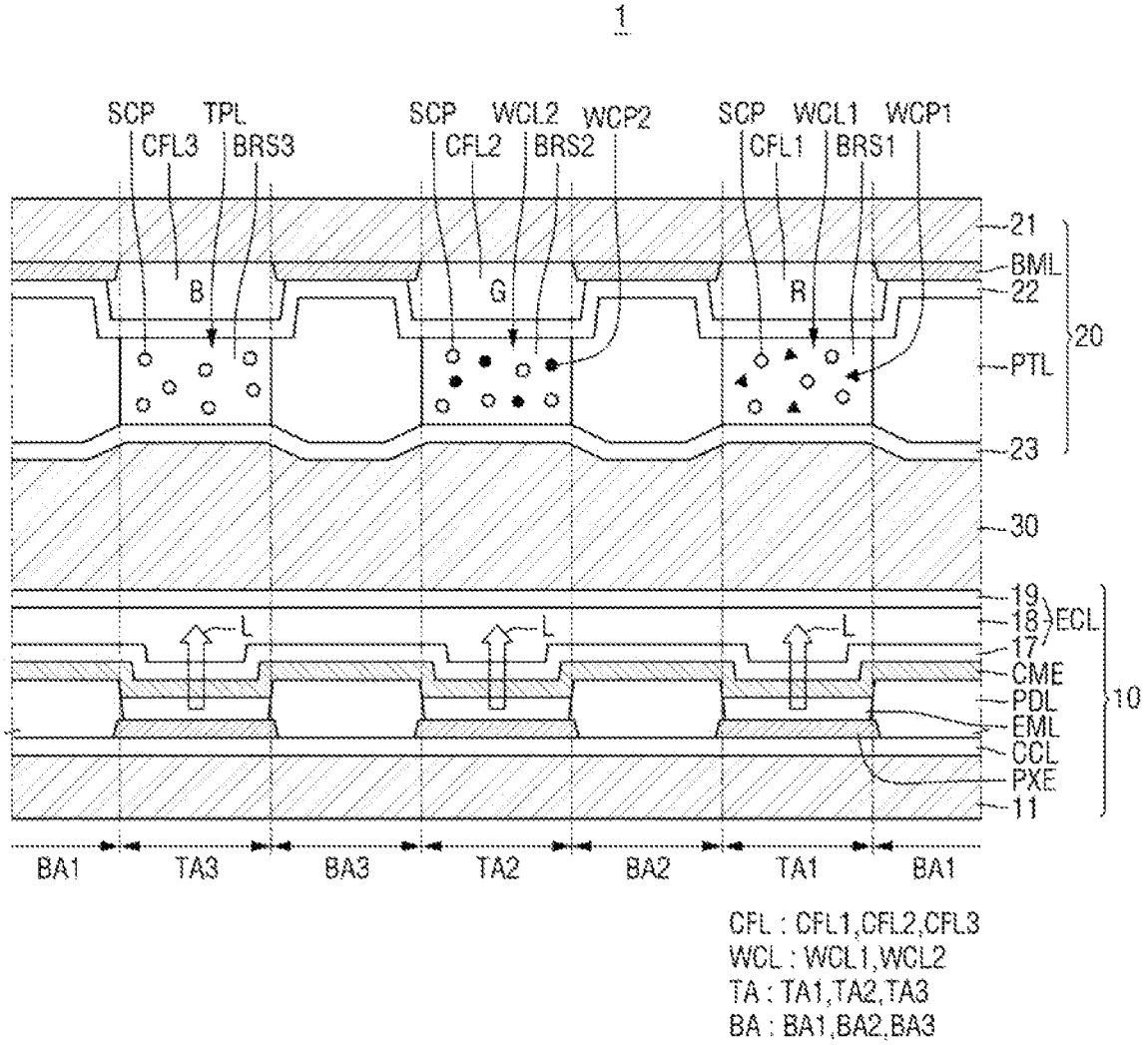
FIG. 2 is a cross-sectional view of the display device of FIG. 1.

FIG. 2 is a cross-sectional view of a display device according to an embodiment.

Referring to FIG. 2, the display device 1 may include a first display substrate 10, a second display substrate 20 facing the first display substrate 10, and a filling layer 30 interposed between the first display substrate 10 and the second display substrate 20. For example, the filling layer 30 may bond the first display substrate 10 to the second display substrate 20.

The first display substrate 10 may include a first substrate 11, a pixel electrode PXE disposed for each pixel PX of the first substrate 11, a pixel defining layer PDL disposed along the boundaries of the pixels PX of the first substrate 11, a light emitting layer EML positioned in openings exposed by the pixel defining layer PDL and disposed on the pixel electrodes PXE, a common electrode CME disposed on the light emitting layer EML and the pixel defining layer PDL and disposed over the plurality of pixels PX, and an encapsulation structure ECL disposed on the common electrode CME.

The pixel defining layer PDL may overlap an edge portion of the pixel electrode PXE. The light emitting layer EML includes an organic light emitting material. The organic light emitting material of the light emitting layer EML may emit the same color regardless of the kinds/types of the pixels PX. For example, the light emitting layer EML may emit blue light from all of the red, green, and blue pixels PX. However, embodiments are not limited thereto. The pixel defining layer PDL may include the openings exposing the pixel electrodes PXE. Light transmitting areas TA and light blocking areas BA may be defined by the pixel defining layer PDL and the openings of the pixel defining layer PDL.

The thin film encapsulation structure ECL may include at least one thin film encapsulation layer. For example, the thin film encapsulation layer may include a first inorganic layer 17, an organic layer 18, and a second inorganic layer 19.

The second display substrate 20 may include a second substrate 21, light blocking members BML disposed on one surface of the second substrate 21 facing the first substrate 11, a color filter layer CFL disposed on one surface of the second substrate 21 in openings defined by the light blocking members BML, a first capping layer 22 disposed on the color filter layer CFL and the light blocking members BML, partition walls PTL disposed on the first capping layer 22 and overlapping the light blocking members BML, a wavelength conversion layer WCL and a light transmitting layer TPL disposed in spaces surrounded by the partition walls PTL, and a second capping layer 23 disposed on the wavelength conversion layer WCL, the light transmitting layer TPL, and the partition walls PTL.

The light blocking members BML may be disposed in the light blocking areas BA to overlap the pixel defining layer PDL, and include the openings that expose one surface of the second substrate 21 while overlapping the light transmitting areas TA.

The color filter layer CFL may include a first color filter layer CFL1 disposed in the first color pixel PX, a second color filter layer CFL2 disposed in the second color pixel PX and a third color filter layer CFL3 disposed in the third color pixel PX. For example, the first color filter layer CFL1 may be a red color filter layer, the second color filter layer CFL2 may be a green color filter layer, and the third color filter layer CFL3 may be a blue color filter layer.

The wavelength conversion layer WCL may include a first wavelength conversion pattern WCL1 disposed in the first color pixel PX and a second wavelength conversion pattern WCL2 disposed in the second color pixel PX. The light transmitting layer TPL may be disposed in the third color pixel PX.

The first wavelength conversion pattern WCL1 may include a first base resin BRS1 and a first wavelength conversion material WCP1 provided in the first base resin BRS1. The second wavelength conversion pattern WCL2 may include a second base resin BRS2 and a second wavelength conversion material WCP2 provided in the second base resin BRS2. The light transmitting layer TPL may include a third base resin BRS3 and scatterers SCP provided in the third base resin BRS3.

The first, second, and third base resins BRS1, BRS2, and BRS3 may include a light-transmitting organic material. For example, the first, second, and third base resins BRS1, BRS2, and BRS3 may include an epoxy resin, an acrylic resin, a cardo resin, an imide resin or the like. The first, second, and third base resins BRS1, BRS2 and BRS3 may be formed of the same material, but embodiments are not limited thereto.

The scatterers SCP may be metal oxide particles or organic particles. Examples of the metal oxide may include titanium oxide ($TiO_2$), zirconium oxide ($ZrO_2$), aluminum oxide ($Al_2O_3$), indium oxide ($In_2O_3$), zinc oxide (ZnO), tin oxide ($SnO_2$), and the like. Examples of a material of the organic particles may include acrylic resin and urethane resin, and the like.

The first wavelength conversion material WCP1 may convert the third color light into the first color light, and the second wavelength conversion material WCP2 may convert the third color light into the second color light. The first wavelength conversion material WCP1 and the second wavelength conversion material WCP2 may be quantum dots, quantum bars, phosphors or the like. Examples of the quantum dots may include group IV nanocrystals, group II-VI compound nanocrystals, group III-V compound nanocrystals, group IV-VI nanocrystals, and combinations thereof. The first wavelength conversion pattern WCL1 and the second wavelength conversion pattern WCL2 may further include scatterers SCP for increasing wavelength conversion efficiency.

The light transmitting layer TPL disposed in the third color pixel PX transmits the third color light emitted from the light emitting layer EML while maintaining the wavelength of the light. The scatterers SCP of the light transmitting layer TPL may serve to control an emission path of the light emitted through the light transmitting layer TPL. The light transmitting layer TPL may not include a wavelength conversion material.

The filling layer 30 may be disposed between the first display substrate 10 and the second display substrate 20. The filling layer 30 may fill a space between the first display substrate 10 and the second display substrate 20, and may bond the first display substrate 10 to the second display substrate 20. The filling layer 30 may be disposed between the thin film encapsulation structure ECL of the first display substrate 10 and the second capping layer 23 of the second display substrate 20.

As described above, in the display device 1, the pixel electrode PXE, the pixel defining layer PDL, the light emitting layer EML, the light blocking member BML, the color filter layer CFL, the partition wall PTL, the wavelength conversion layer WCL, the light transmitting layer TPL, and the like have specific pattern shapes. In order to form such members, the photo process or the inkjet process may be used. Hereinafter, a patterning process will be described in detail through manufacturing processes of the second display substrate 20 according to embodiments.

FIGS. 3, 4, 5, 6, and 7 are cross-sectional views illustrating a part of a manufacturing process of a display device according to an embodiment and schematically illustrate a manufacturing process of the second display substrate 20.

Figure 3:
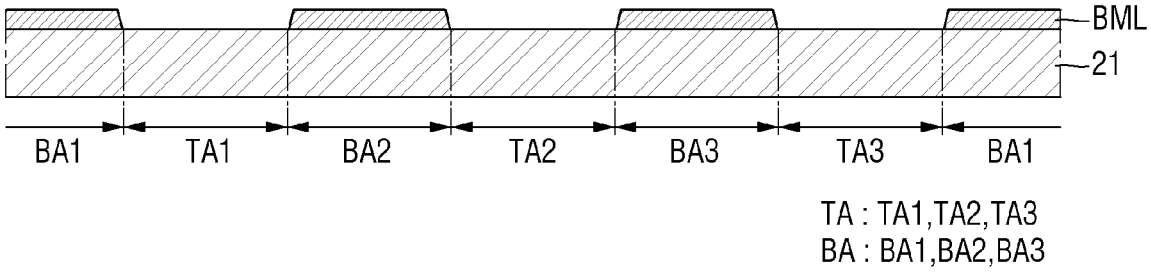
FIGS. 3, 4, 5, 6, and 7 are cross-sectional views illustrating a part of a manufacturing process of the display device of FIG. 1.

Firstly, referring to FIG. 3, the light blocking members BML may be formed on one surface of the second substrate 21. For example, the light blocking members BML may be patterned through an exposure/development process or a photolithography process after coating a light blocking material. The light blocking members BML may form a lattice pattern on one surface of the second substrate 21.

Figure 4:
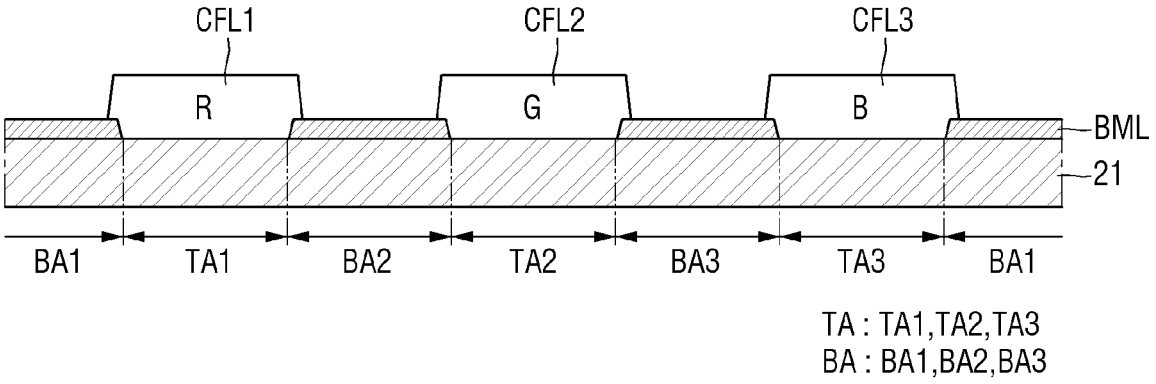

Next, referring to FIG. 4, the color filter layer CFL may be formed on one surface of the second substrate 21 and disposed between the light blocking members BML (e.g., in a horizontal direction). The color filter layer CFL may be formed in a region overlapping each of the light transmitting areas TA. The color filter layer CFL may be patterned through an exposure/development process or a photolithography process, or may be patterned using the inkjet printing apparatus (e.g., 1000 of FIG. 8).

Subsequently, referring to FIG. 5, the first capping layer 22 that covers the color filter layer CFL and the light blocking members BML is formed, and the partition walls PTL are formed in a region overlapping first, second, and third light blocking areas BA1, BA2, and BA3. The partition walls PTL may be patterned through, for example, an exposure/development process or a photolithography process.

Thereafter, the wavelength conversion layer WCL and the light transmitting layer TPL are formed in the spaces surrounded by partition walls PTL. In an embodiment, the wavelength conversion layer WCL and the light transmitting layer TPL may be formed using the inkjet printing apparatus 1000.

Figure 5:
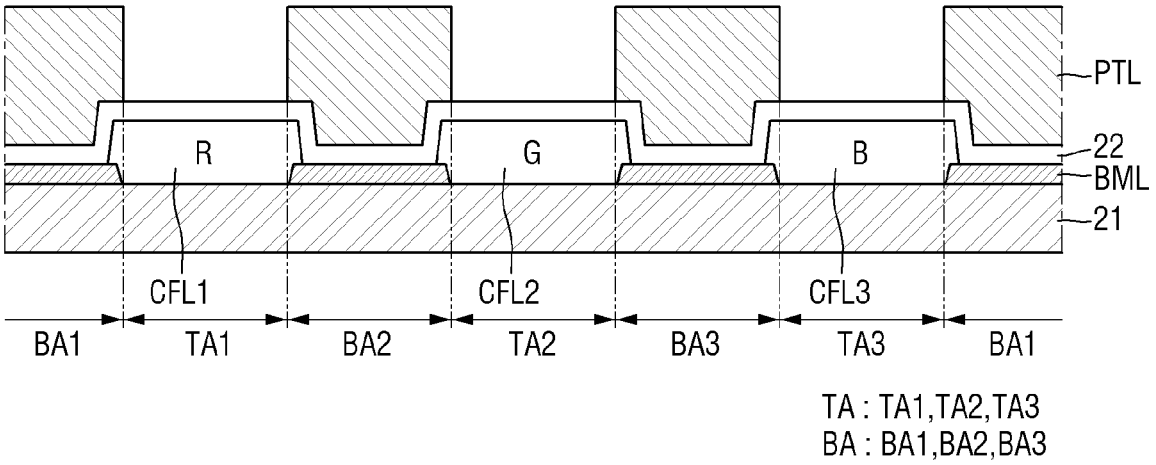
Figure 6:
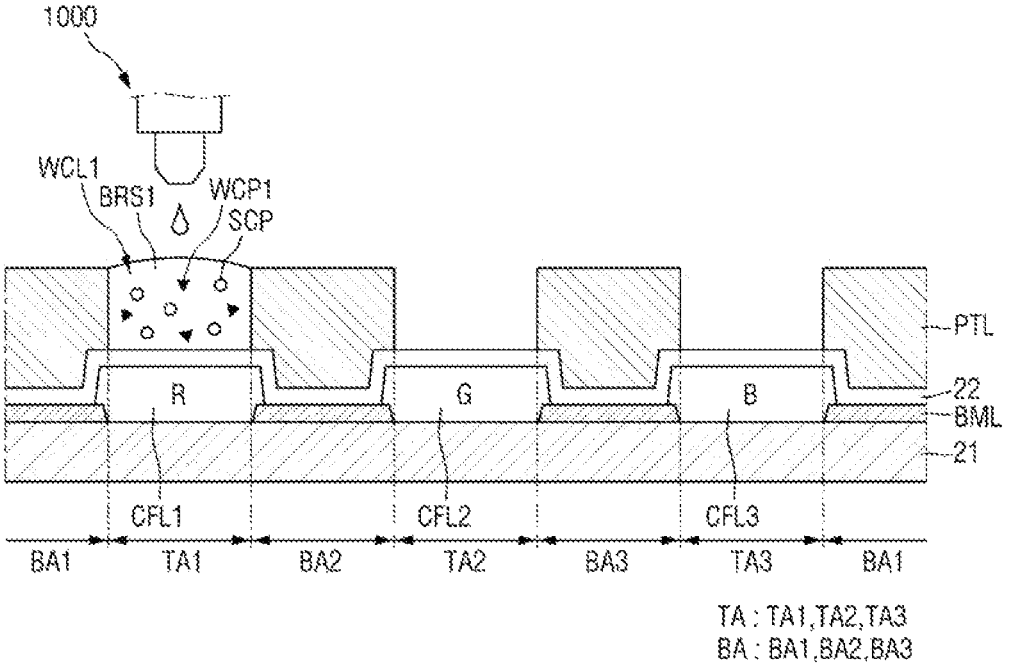

For example, after the step illustrated in FIG. 5, referring to FIG. 6, the first wavelength conversion pattern WCL1 may be formed by spraying ink onto a first light transmitting area TA1 using the inkjet printing apparatus 1000. The first wavelength conversion pattern WCL1 may be formed in the first light transmitting area TA1 surrounded by the partition walls PTL. The first wavelength conversion pattern WCL1 may be formed by spraying the ink onto the first light transmitting area TA1 through a nozzle of the inkjet printing apparatus 1000.

Figure 7:
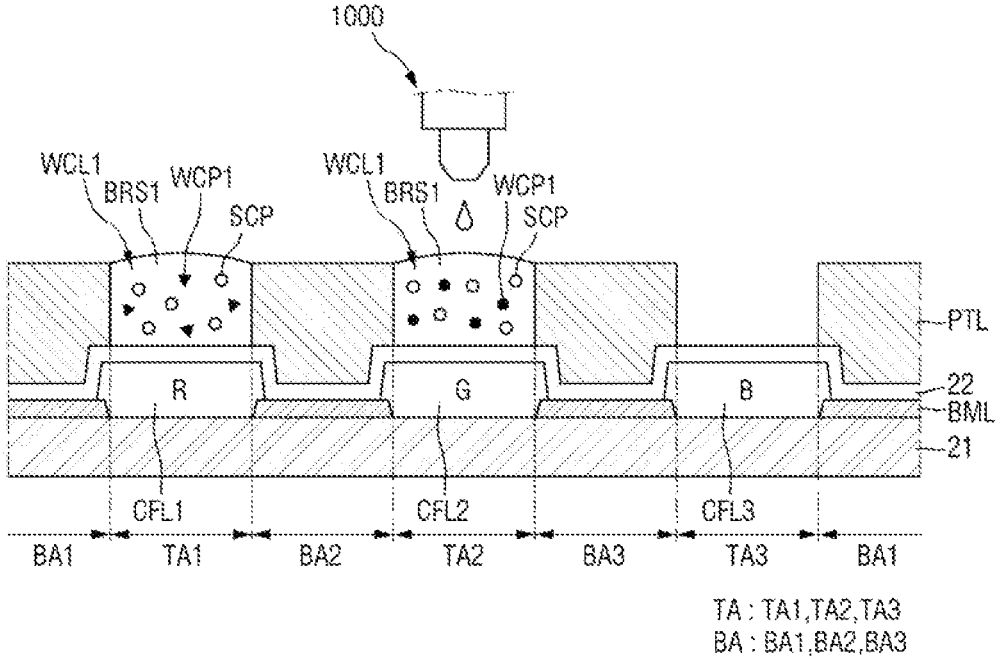

Next, referring to FIG. 7, the second wavelength conversion pattern WCL2 may be formed by spraying ink onto a second light transmitting area TA2 using the inkjet printing apparatus 1000. The second wavelength conversion pattern WCL2 may be formed in the second light transmitting area TA2 surrounded by the partition walls PTL. The second wavelength conversion pattern WCL2 may be formed by spraying the ink onto the second light transmitting area TA2 through a nozzle or an inkjet print head different from that used for forming the first wavelength conversion pattern WCL1. In another embodiment, the second wavelength conversion pattern WCL2 may be formed using an inkjet printing apparatus different from the inkjet printing apparatus 1000 used for forming the first wavelength conversion pattern WCL1.

For example, the process of forming the light transmitting layer TPL is similar to the process for forming the first wavelength conversion pattern WCL1 and the second wavelength conversion pattern WCL2. The light transmitting layer TPL may be formed in a third light transmitting area TA3 surrounded by the partition walls PTL. The light transmitting layer TPL may be formed by spraying ink onto the third light transmitting area TA3 through a nozzle different from the nozzles used for forming the first and second wavelength conversion patterns WCL1 and WCL2.

Hereinafter, the above-mentioned inkjet printing apparatus 1000 will be described in detail.

Figure 8:
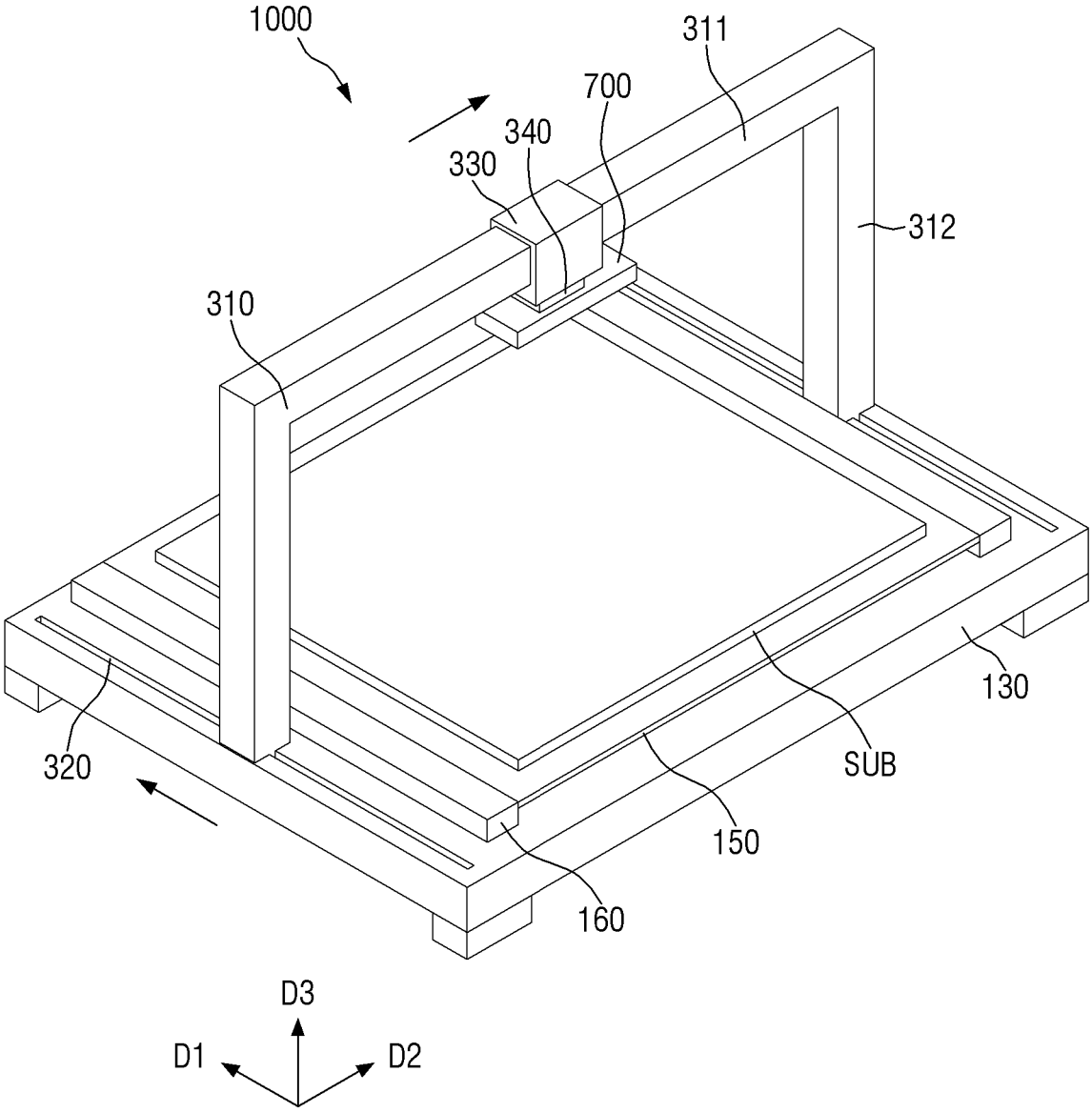
FIG. 8 is a perspective view of an embodiment of an inkjet printing apparatus constructed according to the principles of the invention.

FIG. 8 is a perspective view showing an inkjet printing apparatus according to an embodiment.

Referring to FIG. 8, the inkjet printing apparatus 1000 according to an embodiment may include a base frame 130, a stage 150, a stage moving unit 160, print head moving units 320, 330, and 340, and a head unit 700.

The stage 150 may be disposed on the base frame 130. The stage 150 provides a space for placing a target substrate SUB. For example, the target substrate SUB to be subjected to the printing process may be mounted on the top surface of the stage 150. A substrate aligner may be installed above the stage 150 to align the target substrate SUB. The substrate aligner may be made of quartz or a ceramic material, and may be provided in the form of an electrostatic chuck, but embodiments are not limited thereto.

The stage 150 may be made of a transparent or translucent material capable of transmitting light, or an opaque material capable of reflecting light. The overall planar shape of the stage 150 may be similar to (or substantially same as) the planar shape of the target substrate SUB. For example, when the target substrate SUB has a rectangular shape, the overall shape of the stage 150 may be rectangular, and when the target substrate SUB has a circular shape, the overall shape of the stage 150 may be circular. In the drawing, there is illustrated the stage 150 having a rectangular shape in which the long sides are disposed in a second direction D2 and the short sides are disposed in a first direction D1.

The stage 150 may be fixed to the stage moving unit 160 and may move together along the movement of the stage moving unit 160. The stage moving unit 160 may be installed on the base frame 130 and may move on the base frame 130 along the first direction D1. When the stage moving unit 160 is provided, a second horizontal moving unit 320 for moving the head unit 700 in the first direction D1 may be omitted. A detailed description thereof will be given later.

The head unit 700 may be disposed above the stage 150 (e.g., in a third direction D3). The head unit 700 may print ink on the target substrate SUB. The inkjet printing apparatus 1000 may further include an ink supply unit such as an ink cartridge, and the ink supplied from the ink supply unit may be sprayed (or ejected) toward the target substrate SUB through the head unit 700.

The ink may be provided in a solution state. The ink may include, for example, a solvent and an organic material contained in the solvent. The organic material may be dispersed in the solvent. The organic material may be the base resin, the scatterers, and the wavelength conversion material described above with reference to FIG. 2. The organic material may finally remain on the target substrate SUB after the solvent is removed. The solvent may be a material that is vaporized or volatilized at room temperature or by heat. The solvent may be acetone, water, alcohol, toluene, or the like.

The head unit 700 may be mounted on a support unit 310 and spaced apart from the stage 150 by a predetermined distance. The support unit 310 may include a horizontal support part 311 extending in a horizontal direction (e.g., the first direction D1 or the second direction D2) and vertical support parts 312 connected to the horizontal support part 311 and extending in a vertical direction (e.g., the third direction D3). The extending direction of the horizontal support part 311 may be the same as the second direction D2 which is the long side direction of the stage 150. Ends of the vertical support parts 312 may be placed on the base frame 130.

The distance between the head unit 700 and the stage 150 may be adjusted by the height of the support unit 310. When the target substrate SUB is placed on the stage 150, the distance between the head unit 700 and the stage 150 may be adjusted within a range in which a process space can be secured by disposing the head unit 700 to have a certain distance from the target substrate SUB.

For example, although one head unit 700 is illustrated in the drawing, but embodiments are not limited thereto. For example, in the case of a process of providing a plurality of inks to the target substrate SUB, the same number of head units 700 as the kinds of the inks may be provided.

The head unit 700 may be moved in the horizontal or vertical direction by the print head moving unit. The print head moving unit may include a first horizontal moving unit 330, a second horizontal moving unit 320, and a vertical moving unit 340.

The first horizontal moving unit 330 may be installed on the horizontal support part 311, and the second horizontal moving unit 320 may be installed on the base frame 130.

The first horizontal moving unit 330 may move the head unit 700 on the horizontal support part 311 in the second direction D2. The second horizontal moving unit 320 may move the vertical support parts 312 in the first direction D1 to move the head unit 700 mounted on the support unit 310 in the first direction D1.

Through the horizontal movement by the first horizontal moving unit 330 and the second horizontal moving unit 320, the ink may be sprayed to the entire area of the target substrate SUB even using the head unit 700 having an area smaller than that of the target substrate SUB to perform the printing process.

The vertical moving unit 340 may adjust the distance between the head unit 700 and the stage 150 by lifting or lowering the head unit 700 on the horizontal support part 311 in the vertical direction. For example, when the target substrate SUB is placed on the stage 150, the position of the head unit 700 may be adjusted within a range in which a process space can be secured by disposing the head unit 700 to have a certain distance from the target substrate SUB by the vertical moving unit 340.

Figure 9:
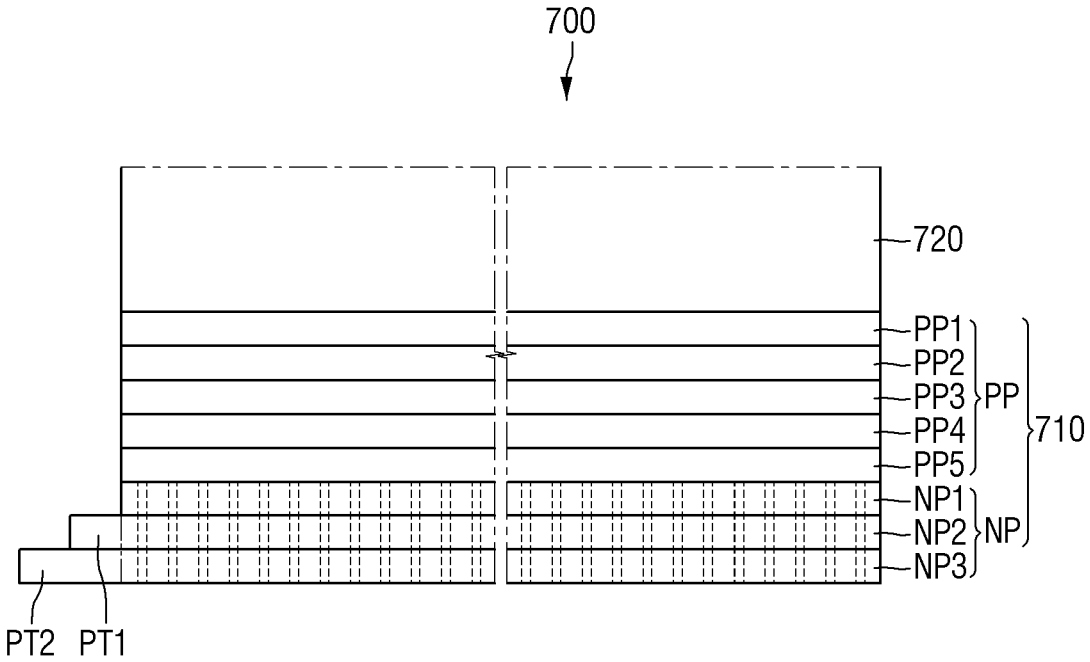
FIG. 9 is a perspective view of a head unit of the inkjet printing apparatus of FIG. 8.
Figure 10:
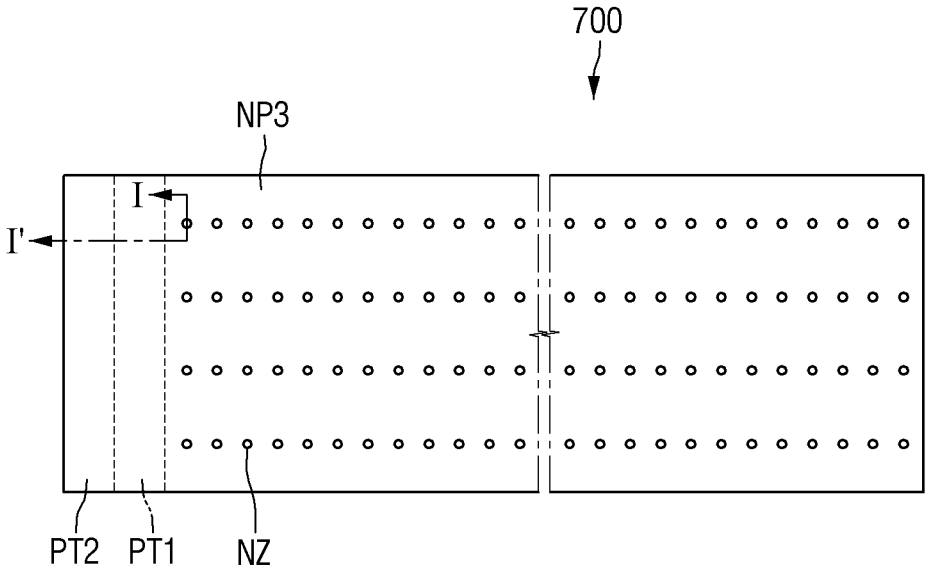
FIG. 10 is a bottom view of the head unit of the inkjet printing apparatus of FIG. 8.
Figure 11:
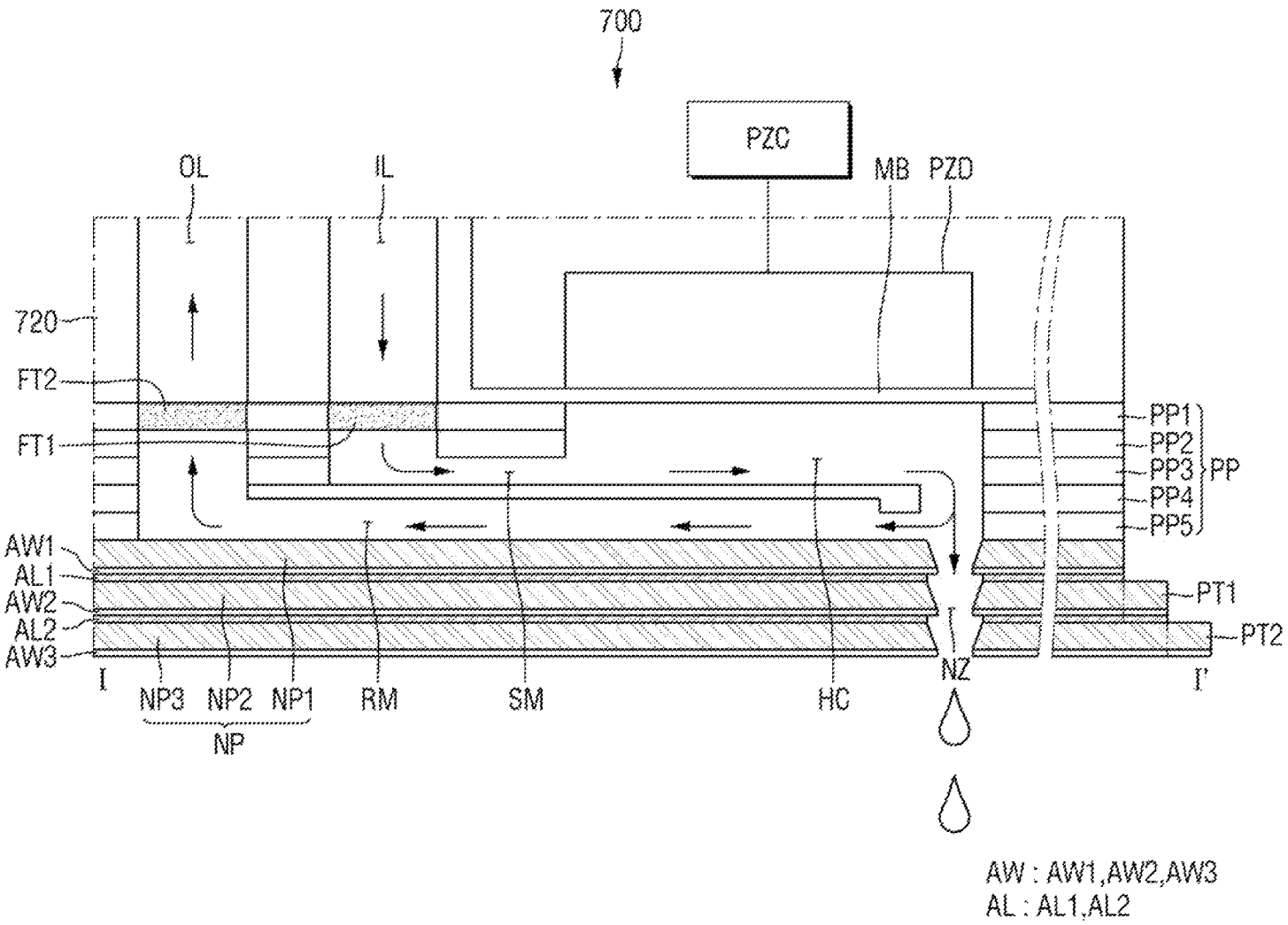
FIG. 11 is a cross-sectional view taken along line I-I' of FIG. 10.

FIG. 9 is a perspective view of a head unit according to an embodiment. FIG. 10 is a bottom view of a head unit according to an embodiment. FIG. 11 is a cross-sectional view taken along line I-I' of FIG. 10. The configuration of the head unit 700 will be described in more detail with reference to FIGS. 9, 10, and 11.

The head unit 700 may include a head part 710 and a body part 720.

The body part 720 may include a body chamber formed therein. Ink may be supplied to the body chamber of the body part 720, and the supplied ink may flow into a head chamber HC through a first internal passage SM of the head part 710 to be described later. As will be described later, the ink that has not been ejected through a nozzle NZ may return back to the body chamber through a second internal passage RM.

The head part 710 may form the bottom surface of the head unit 700. For example, the head part 710 may face the stage 150 disposed under the head unit 700. The head part 710 may have a shape extending along one direction. The extending direction of the head part 710 may be the same as the extending direction of the horizontal support part 311 of the support unit 310. For example, the extending direction of the head part 710 may be the second direction D2 which is the long side direction of the stage 150.

The head part 710 may include the nozzle NZ, the internal passages SM and RM, and the head chamber HC. The head part 710 may further include a plurality of plates NP and PP which are stacked. The plurality of plates NP and PP may include one or more nozzle plates NP and one or more passage plates PP. The one or more nozzle plates NP may be disposed at a relatively lower side than the one or more passage plates PP. Portions of the stacked plates NP and PP may be removed to define a specific space, e.g., the nozzle NZ, the internal passages SM and RM, and the head chamber HC. The nozzle NZ may be formed by the one or more nozzle plates NP, and the internal passages SM and RM and the head chamber HC may be formed by the one or more passage plates PP.

The internal passages SM and RM may include the first internal passage SM which provides a path through which the ink moves from the body chamber to the head chamber HC, and the second internal passage RM which provides a path through which some portion of the ink (which is not ejected through the nozzle NZ) returns back to the body chamber.

Filters FT1 and FT2 for removing foreign substances included in the ink may be installed inside the internal passages SM and RM. A first filter FT1 may be disposed inside the first internal passage SM, and a second filter FT2 may be disposed inside the second internal passage RM. The first filter FT1 and the second filter FT2 may pass the ink, while filtering out the foreign substances such as air bubbles.

The first filter FT1 may cover the entire width of the first internal passage SM, and the second filter FT2 may cover the entire width of the second internal passage RM. Therefore, the ink flowing through the first internal passage SM may all pass through the first filter FT1, and the ink flowing through the second internal passage RM may all pass through the second filter FT2.

The head chamber HC may provide a space for storing the ink in the head part 710. As will be described later, the volume of the head chamber HC may be changed by the deformation of a membrane MB disposed on the head chamber HC.

A plurality of nozzles NZ may be formed in the head part 710. In an embodiment, the number of the nozzles NZ included in one head part 710 may be 128 to 1800, but embodiments are not limited thereto.

The plurality of nozzles NZ may provide a path through which the ink is ejected. The plurality of nozzles NZ may penetrate the nozzle plate NP to be spatially connected to the internal passages SM and RM and the head chamber HC. For example, the plurality of nozzles NZ may be in fluid connection, e.g., communication, with the internal passages SM and RM and the head chamber HC. The specific shape of the nozzle NZ will be described later.

The nozzle NZ may be formed inside the nozzle plate NP. As described above, the head unit 700 may include a plurality of nozzle plates NP. The plurality of nozzle plates NP may form a stacked structure. In an embodiment, the head unit 700 may include three nozzle plates NP. Hereinafter, the head unit 700 including three nozzle plates NP, e.g., a first nozzle plate NP1 constituting the bottom surface of the second internal passage RM, a second nozzle plate NP2 disposed under the first nozzle plate NP1, and a third nozzle plate NP3 disposed under the second nozzle plate NP2, will be described as an example, but embodiments are not limited to the number of the nozzle plates NP included in one head unit 700.

A water repellent layer AW may be disposed on the bottom surface of each nozzle plate NP. The water repellent layer AW may cover the entire bottom surface of each nozzle plate NP. Here, the term "water-repellent" may mean preventing from getting wet by liquids such as ink, as well as water. Specifically, a first water repellent layer AW1 may be disposed on the bottom surface of the first nozzle plate NP1, a second water repellent layer AW2 may be disposed on the bottom surface of the second nozzle plate NP2, and a third water repellent layer AW3 may be disposed on the bottom surface of the third nozzle plate NP3.

The surface properties of the nozzle plates NP may affect the droplet size of the ejected ink and the ink ejection performance and the stability of the nozzle NZ.

When the bottom surface of the nozzle plate NP has hydrophilicity, the bottom surface of the nozzle plate NP may be wetted by ink or the like as the ink is repeatedly ejected. When the surface of the nozzle plate NP is wet, the ink forms a lump with wet ink on the surface of the nozzle plate NP, so that the ink may be ejected in a flow-down manner without forming a complete liquid drop shape. As a result, the ejection direction of the ink may be distorted and the ejection speed of the ink may be reduced, thereby deteriorating the print quality and making the meniscus formed after ejecting the ink unstable.

The water repellent layer AW may prevent the bottom surface of the nozzle plate NP from getting wet by the ink, thereby improving the ejection performance of the nozzle NZ described above. The water repellent layer AW may be formed using a silicone compound or a fluorine compound. For example, polytetra teflon ethyleneglycol (PTFE), which is a Teflon-based material, may be used. In addition, the water repellent layer AW may be formed by various coating or deposition methods. For example, the water repellent layer AW may be formed by spin coating, physical vapor deposition (PVD), chemical vapor deposition (CVD), atomic layer deposition (ALD), or the like.

An adhesive layer AL may be interposed between the nozzle plates NP. The nozzle plates NP may be bonded to each other through the adhesive layer AL. Specifically, the top surface of the adhesive layer AL may contact the water repellent layer AW disposed on the bottom surface of the upper nozzle plate NP, and the bottom surface of the adhesive layer AL may contact the top surface of the lower nozzle plate NP. The adhesive layer AL may cover the entire top surface of the nozzle plate NP that is in contact with the corresponding adhesive layer AL. In an embodiment, a first adhesive layer AL1 may be interposed between the first water repellent layer AW1 and the second nozzle plate NP2, and a second adhesive layer AL2 may be interposed between the second water repellent layer AW2 and the third nozzle plate NP3.

The adhesive strength between the adhesive layer AL and the top surface of the nozzle plate NP that is in contact with the corresponding adhesive layer AL may be greater than the adhesive strength between the adhesive layer AL and the water repellent layer AW that is in contact with the corresponding adhesive layer AL, but embodiments are not limited thereto. When the lower nozzle plate NP is detached, the water repellent layer AW disposed on the bottom surface of the upper nozzle plate NP may not be detached. The adhesive layer AL may be a thermosetting adhesive sheet containing a thermosetting resin, but embodiments are not limited thereto. For example, the adhesive layer AL may include an adhesive containing various other materials.

The nozzle plates NP may include a plurality of through holes penetrating each nozzle plate NP in the thickness direction (e.g., in the vertical direction). Each of the through holes may have an internal structure in which the width becomes narrower downward. For example, each of the through holes may have an upper side surface having a first width and a lower inner side surface having a second width smaller than the first width. However, embodiments are not limited thereto. For example, each of the through holes may have a structure in which the width is substantially constant or the width increases toward one side in the third direction D3. For example, the upper portion of the through hole may have a larger width than the lower portion thereof.

The through holes of the nozzle plate NP may be formed in a lattice structure. The through holes of the nozzle plate NP may be arranged in one column or a plurality of columns, and each column may include a plurality of through holes. In an embodiment, the nozzle plate NP may include the through holes formed in a lattice structure of 4 columns in the first direction D1 and 320 rows in the second direction D2, but embodiments are not limited thereto.

Since the nozzle plates NP are formed in a stacked structure, the through holes formed in the respective nozzle plates NP may overlap each other. The plurality of through holes overlapping each other in the stacked nozzle plates NP may constitute the nozzle NZ. For example, the nozzle NZ may be a set of the through holes overlapping each other in the nozzle plates NP. The nozzle NZ may have an internal structure in which the internal structure of the through hole described above is repeated as many as the number of the nozzle plates NP. In an embodiment, the plurality of nozzles NZ may be formed in a lattice structure of 4 columns in the first direction D1 and 320 rows in the second direction D2, but embodiments are not limited thereto.

The ink supplied from the first internal passage SM may be ejected through the plurality of nozzles NZ. The ink ejected through the plurality of nozzles NZ may be supplied to the top surface of the target substrate SUB. In an embodiment, a single ejection amount of each nozzle NZ may be 1 to 50 pl (picoliter), but embodiments are not limited thereto. The ejection amount of the ink through the nozzles NZ may be adjusted by a piezoelectric driver PZD. A detailed description of the piezoelectric driver PZD will be described later.

The nozzle plate NP may include a protrusion PT1 or PT2 protruding outward. The protrusion PT1 or PT2 in one nozzle plate NP may be a portion protruding outward compared to the nozzle plate NP disposed thereon. The protrusion PT1 or PT2 may facilitate detachment of the nozzle plate NP physically connected to the corresponding protrusion PT1 or PT2. For example, the protrusion PT1 or PT2 may be gripped with a tool such as pliers or nippers to detach the nozzle plate NP to which the corresponding protrusion PT1 or PT2 is connected.

The protrusion PT1 or PT2 may be disposed on one of the several sides of the nozzle plate NP, but embodiments are not limited thereto and may be disposed on the plurality of sides. In the nozzle plate NP including the protrusion PT1 or PT2, the protrusion PT1 or PT2 may protrude outward over the entire one side surface of the nozzle plate NP, but embodiments are not limited thereto.

In an embodiment, the second nozzle plate NP2 may include a first protrusion PT1, and the third nozzle plate NP3 may include a second protrusion PT2. The first nozzle plate NP1 in contact with the passage plate PP may not include the protrusion PT1 or PT2, but embodiments are not limited thereto. For example, the first protrusion PT1 may be an upper protrusion, and the second protrusion PT2 may be a lower protrusion under the upper protrusion.

The nozzle plate NP may be formed from a substrate made of a material having good fine processability. For example, the nozzle plate NP may be formed from a stainless steel substrate or a silicon substrate, but embodiments are not limited thereto. The thickness of the nozzle plate NP may be about 20 μm to 100 μm. For example, the nozzle plate NP may have a thickness of about 50 μm, but embodiments are not limited thereto.

The passage plate PP may be disposed on the nozzle plate NP. The passage plate PP may form the head chamber HC and the internal passages SM and RM described above.

The head unit 700 according to an embodiment may include a plurality of passage plates PP. The plurality of passage plates PP may have a stacked structure. In an embodiment, the head unit 700 may include five passage plates PP. Hereinafter, the head unit 700 including the five passage plates PP, e.g., a fifth passage plate PP5 disposed on the nozzle plate NP, a fourth passage plate PP4 disposed on the fifth passage plate PP5, a third passage plate PP3 disposed on the fourth passage plate PP4, a second passage plate PP2 disposed on the third passage plate PP3, and a first passage plate PP1 disposed on the second passage plate PP2, will be described as an example, but embodiments are not limited to the number of the passage plates PP included in one head unit 700. In addition, the internal passages SM and RM, the head chamber HC, and the like formed inside the passage plates PP may be variously arranged in various forms.

The internal passages SM and RM and the head chamber HC may be formed inside the passage plates PP. The ink supplied from the body chamber of the body part 720 may flow into the inside of the passage plates PP through an ink inlet IL. The head chamber HC may be formed inside the passage plates PP, and the ink introduced through the first internal passage SM may be stored therein. The first internal passage SM that connects the ink inlet IL to the head chamber HC may be formed inside the passage plates PP. The ink filled in the head chamber HC may be ejected in the form of a liquid drop through the nozzle NZ. One head chamber HC may be provided corresponding to each nozzle NZ. Ink that has not been ejected through the nozzle NZ may return back to the body chamber of the body part 720 through the second internal passage RM and an ink outlet OL.

The ink inlet IL may be formed to penetrate the uppermost substrate, e.g., the first passage plate PP1, and the head chamber HC may be formed between the membrane MB and the fourth passage plate PP4.

The first internal passage SM may be formed between the second passage plate PP2 and the fourth passage plate PP4, and the second internal passage RM may be formed between the fourth passage plate PP4 and the nozzle plate NP.

The passage plate PP may be formed from a substrate made of a material having good fine processability. For example, the passage plate PP may be formed from a stainless steel substrate or a silicon substrate, but embodiments are not limited thereto. The thickness of the passage plate PP may be about 20 μm to 100 μm. For example, the passage plate PP may have a thickness of about 50 μm, but embodiments are not limited thereto.

The passage plate PP may be made of the same material and have the same thickness as the nozzle plate NP, but embodiments are not limited thereto.

For example, an adhesive layer may be interposed between the passage plates PP forming a stacked structure. The adhesive layer interposed between the passage plates PP may be made of the same material as the adhesive layer AL interposed between the nozzle plates NP, but embodiments are not limited thereto.

The head unit 700 according to an embodiment may further include the piezoelectric driver PZD. The piezoelectric driver PZD may control the ink ejection amount of each nozzle NZ, and may be disposed one for each nozzle NZ. The piezoelectric driver PZD may be disposed above the head chamber HC. The membrane MB may be disposed between the piezoelectric driver PZD and the head chamber HC. The membrane MB may form the ceiling of the head chamber HC.

When a driving signal is applied to the piezoelectric driver PZD, the membrane MB under the piezoelectric driver PZD may be deformed together with the piezoelectric driver PZD to decrease the volume of the head chamber HC and increase the pressure in the head chamber HC. Due to an increase in the pressure in the head chamber HC, the ink in the head chamber HC may be ejected to the outside through the nozzle NZ.

The driving signal transmitted to the piezoelectric driver PZD may be controlled by a piezoelectric controller PZC disposed outside the head unit 700.

Figure 12:
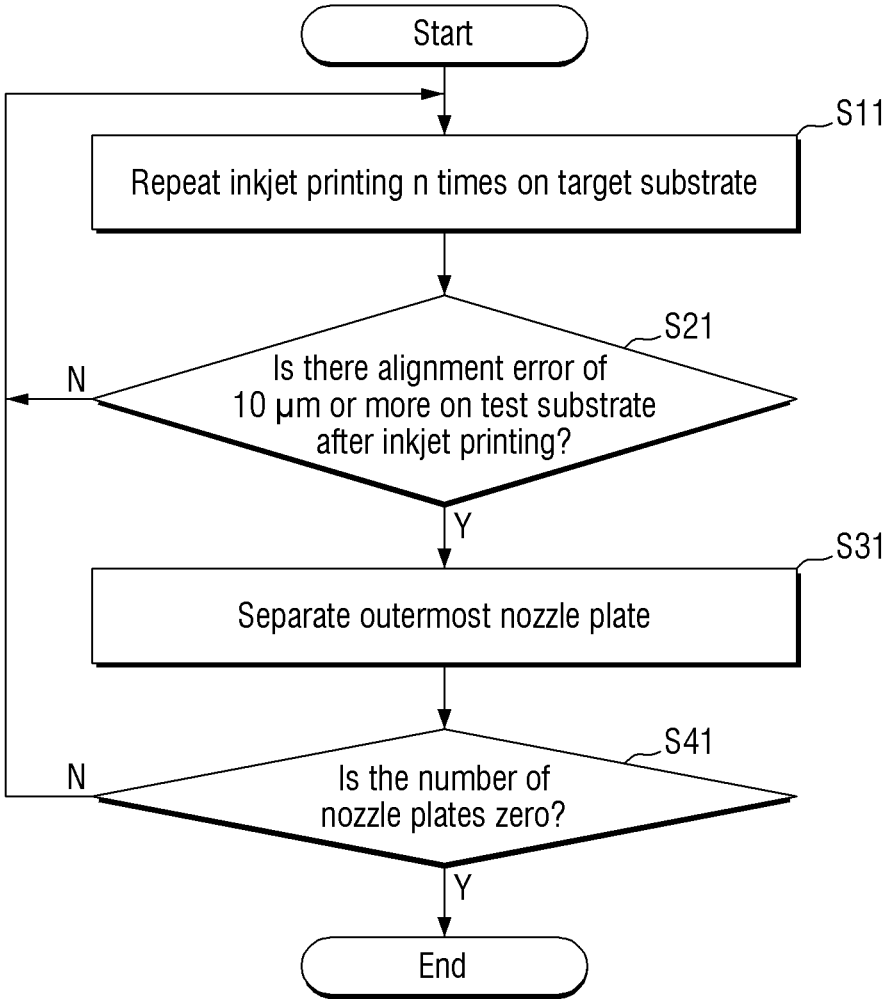
FIG. 12 is a flowchart illustrating a method of a process of inspecting the inkjet printing apparatus of FIG. 8 according to the principles of the invention.
Figure 13:
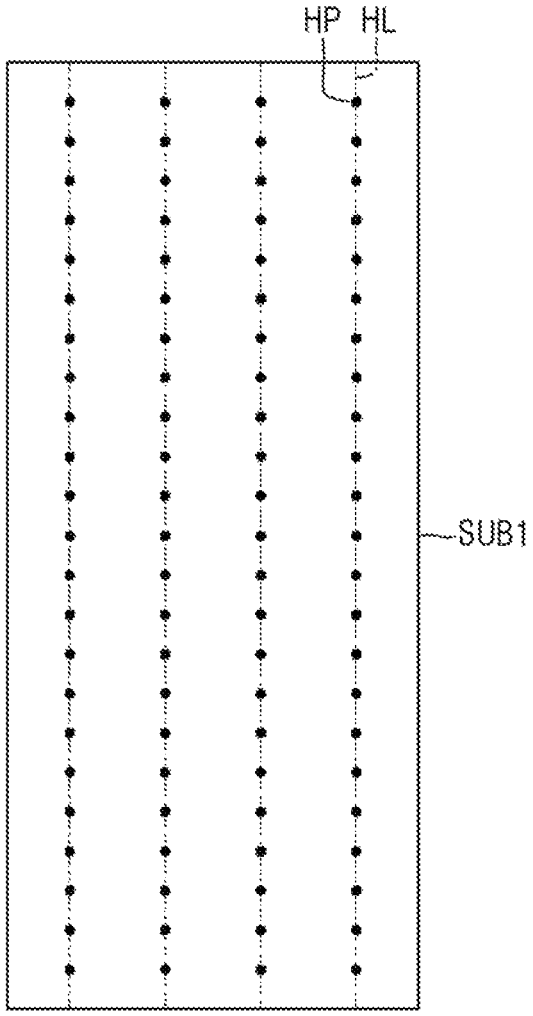
FIGS. 13 and 14 are perspective views of a substrate on which impact points have been formed using the inkjet printing apparatus of FIG. 8.
Figure 14:
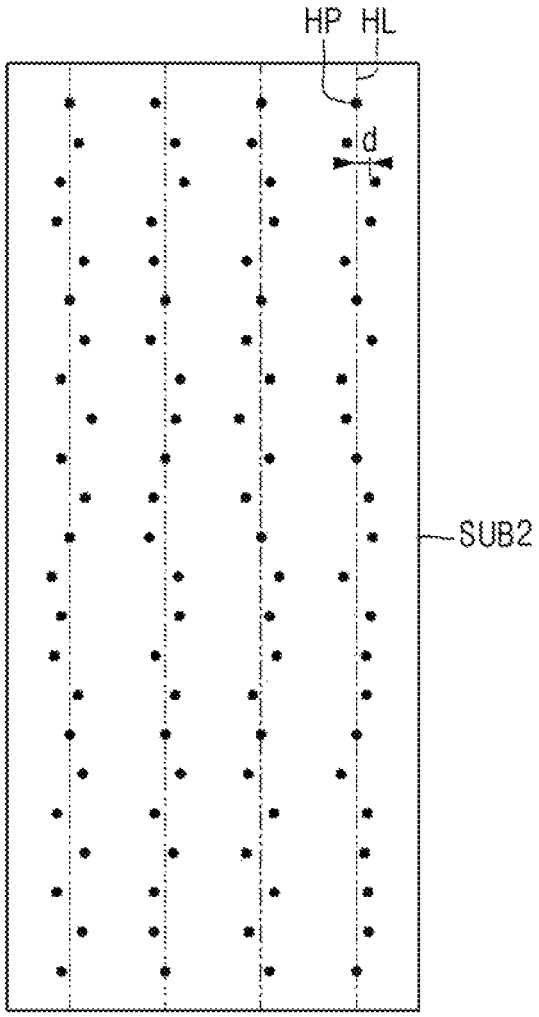
Figure 15:
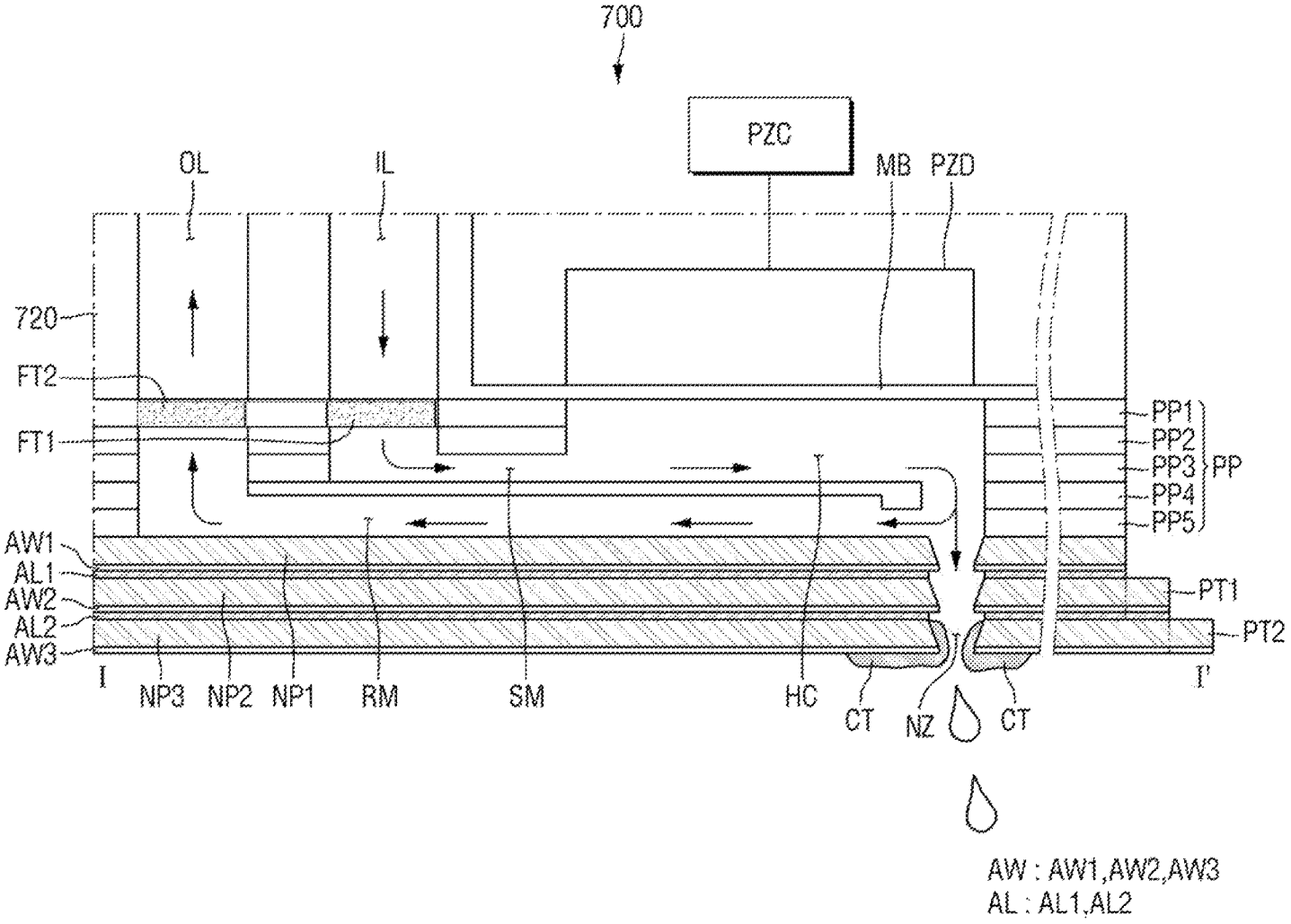
FIGS. 15, 16, and 17 are cross-sectional views illustrating a process of removing a nozzle plate from a contaminated head unit.
Figure 16:
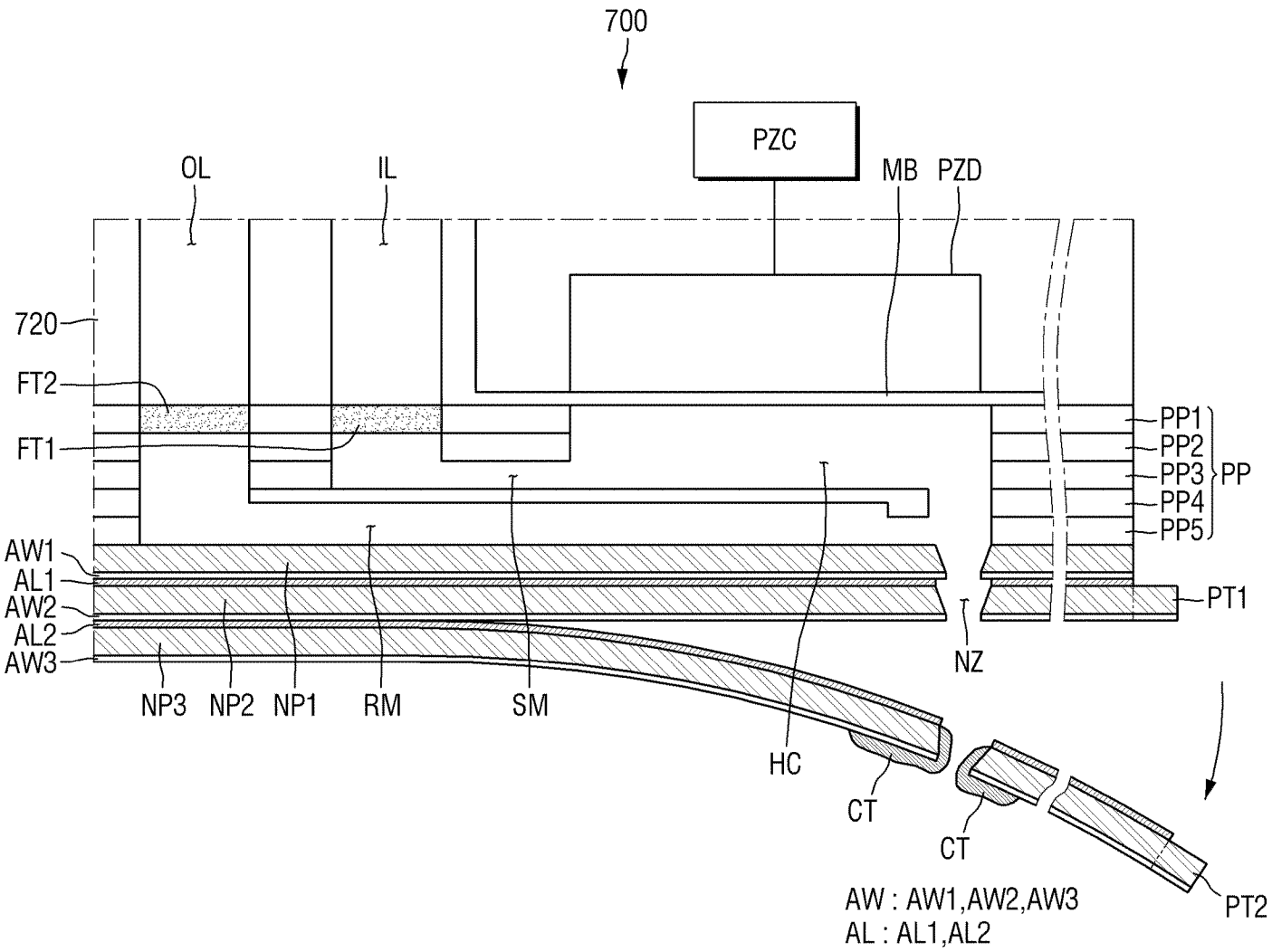
Figure 17:
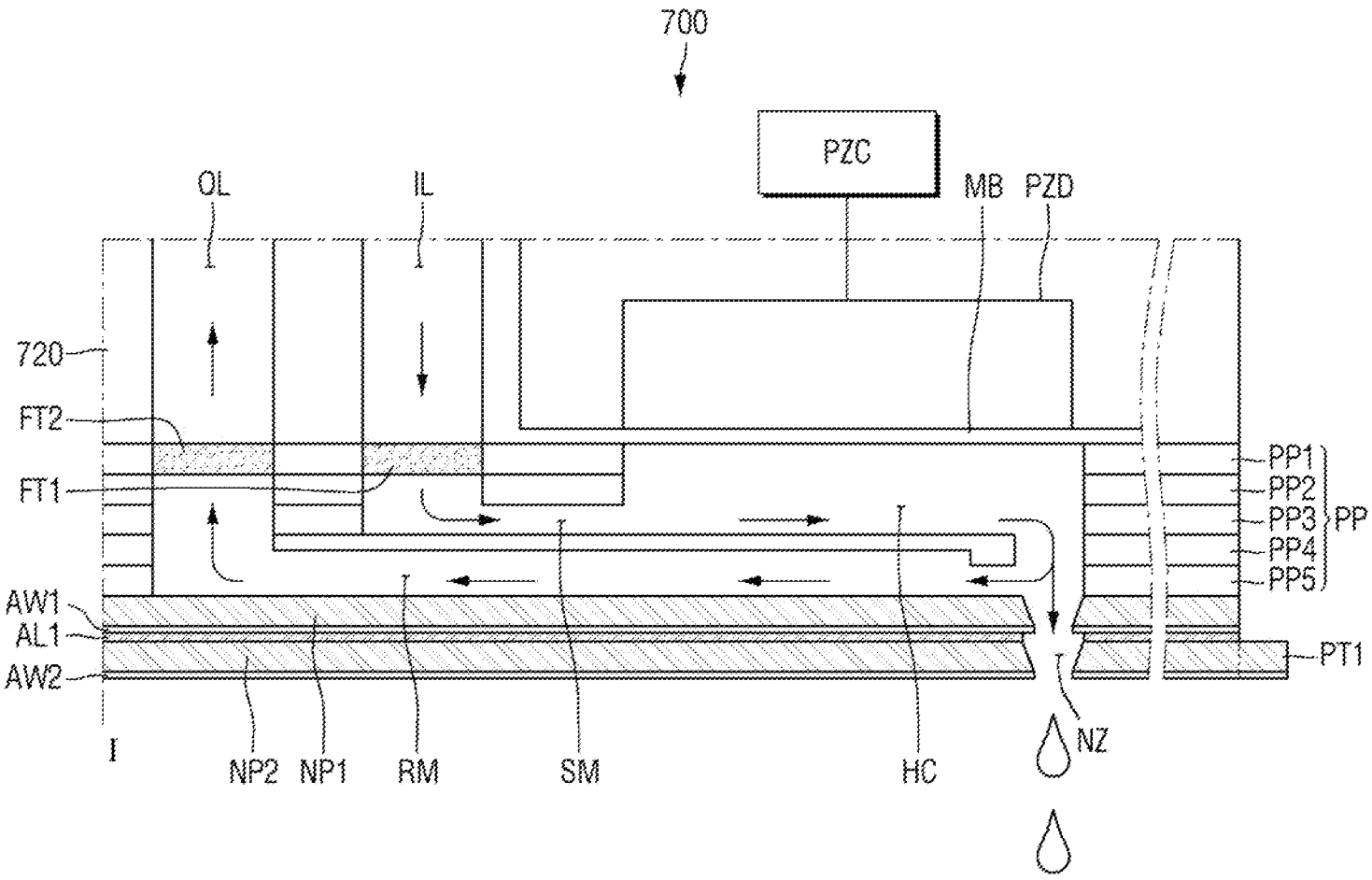

FIG. 12 is a flowchart illustrating a process of inspecting an inkjet printing apparatus according to an embodiment. FIGS. 13 and 14 are perspective views of a substrate on which impact points have been formed using an inkjet printing apparatus according to an embodiment. FIGS. 15, 16, and 17 are cross-sectional views illustrating a process of removing a nozzle plate from a contaminated head unit.

Referring to FIGS. 12, 13, and 14, the process of inspecting the inkjet printing apparatus according to an embodiment may include a process (step S11) of repeating inkjet printing n times on a target substrate SUB1. Then is a positive integer. The ink may be ejected from the inkjet printing apparatus 1000 to form impact points HP on the target substrate SUB1. The impact points HP on the target substrate SUB1 may be arranged in a line. The impact points HP arranged in a line may form an imaginary impact line HL.

When the inkjet printing is performed on the target substrate SUB1 multiple times using the inkjet printing apparatus 1000, contaminants may be gradually formed in the nozzle NZ of the inkjet printing apparatus 1000, and the accumulated contaminants may cause manufacturing errors. For example, the manufacturing errors may include, as shown in FIG. 14, an alignment error d on a test substrate SUB2. For example, when the inkjet printing is performed on the test substrate SUB2, the impact points HP on the test substrate SUB2 may be formed away from the impact line HL. In consideration of the performance of the display device 1, it may be preferable that the alignment error d from the impact line HL to the impact point HP is about 10 μm or less.

Therefore, as a process of testing the inkjet printing apparatus 1000, a process (step S21) of checking the alignment error d on a test substrate SUB2 may be performed whenever the inkjet printing on the target substrate SUB1 is repeated n times. Although the repeated inkjet printing on the target substrate SUB1 has been described to be performed n times, it may be performed for about 10 to 20 hours on the basis of the running time.

The impact points HP imprinted on the test substrate SUB2 may be spaced apart from the impact line HL to form the alignment error d. In this case, when there is no impact point HP having the alignment error d of 10 μm or more, the process (step S11) of inkjet printing on the target substrate SUB1 may be again performed. The process of this case may be performed for a shorter running time than the previously performed inkjet printing process. After that, the process (step S21) of testing the inkjet printing apparatus 1000 may be performed again.

Among the plurality of impact points HP formed on the test substrate SUB2, when there is at least one impact point HP having the alignment error d of 10 μm or more from the impact line HL, the outermost nozzle plate (e.g., the third nozzle plate NP3) may be separated or detached (step S31). By separating the outermost nozzle plate from the head unit 700, contaminants formed around the nozzle NZ may be removed or cleaned.

This process may be repeated until the number of the nozzle plates NP becomes zero (step S41), e.g., until the first nozzle plate NP2 is separated or detached.

Hereinafter, a process of removing, from the head unit 700, the nozzle plate NP on which contaminants have accumulated will be described.

Referring to FIGS. 15, 16, and 17, when an ink ejection process is repeated through the inkjet printing apparatus 1000 according to an embodiment, contaminants CT including organic or inorganic substances contained in the ink may be formed near an ejection opening of the nozzle NZ. For example, the contaminants CT may include the wavelength conversion materials WCP1 and WCP2, the scatterers SCP, and the base resins BRS1, BSR2, and BSR3 described above with reference to FIG. 2.

In this way, when the contaminants CT are formed near the ejection opening of the nozzle NZ, the nozzle NZ may be clogged or an ink ejection path may be changed, thereby resulting in poor ink impact as shown in FIG. 14.

FIG. 15 illustrates a case where the contaminants CT are formed only on the third nozzle plate NP3, which is the outermost nozzle plate NP, but embodiments are not limited thereto, and the contaminants CT may be formed on the plurality of nozzle plates NP.

In order to solve the contamination problem, the nozzle plate NP on which the contaminants CT are formed may be removed. The third nozzle plate NP3 on which the contaminants CT are formed may be detached by gripping the second protrusion PT2. A specific detachment method is the same as that in the description of the protrusion PT1 or PT2 described above.

Once the third nozzle plate NP3 on which the contaminants CT are formed is detached, the ink ejected through the nozzle NZ may form the impact points HP along the straight impact line HL as shown in FIG. 13.

The inkjet printing apparatus 1000 according to an embodiment may include the plurality of nozzle plates NP having a stacked structure, and each of the nozzle plates NP may be easily detached. Accordingly, when a specific nozzle NZ has a problem, only the nozzle plate NP including the specific nozzle NZ among the plurality of nozzle plates NP may be removed, thereby reducing the cost of replacing the head unit 700. Further, the replacement time of the head unit 700 may be shortened, thereby improving production efficiency of the inkjet printing apparatus 1000.

Hereinafter, other embodiments of the inkjet printing apparatus 1000 will be described. In the following embodiments, a description of the same components as those of the above-described embodiment will be omitted or simplified for descriptive convenience, and differences will be mainly described.

Figure 18:
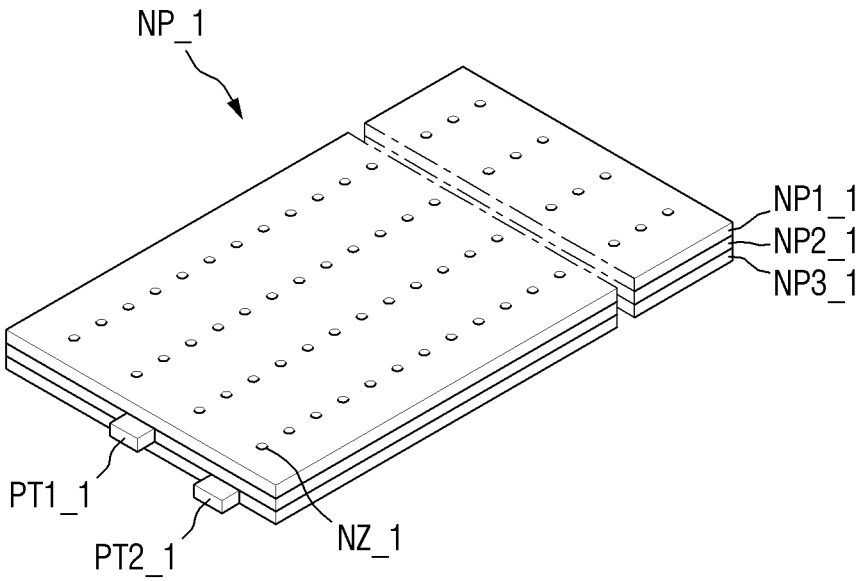
FIG. 18 is a perspective view of another embodiment of a nozzle plate of the head unit of the inkjet printing apparatus of FIG. 8.

FIG. 18 is a perspective view showing a nozzle plate according to another embodiment.

Referring to FIG. 18, an inkjet printing apparatus 1000_1 according to the embodiment is different from the inkjet printing apparatus 1000 according to the above-described embodiment in that the inkjet printing apparatus 1000_1 includes a nozzle plate NP_1 different from the nozzle plate NP included in the inkjet printing apparatus 1000. Hereinafter, the difference between a nozzle plate NP_1 according to the embodiment and the nozzle plate NP according to the above-described embodiment will be mainly described.

The inkjet printing apparatus 1000_1 according to the embodiment may include a protrusion PT1_1 or PT2_1 protruding outward from a portion of one side surface of the nozzle plate NP_1. In FIG. 18, the protrusion PT1_1 or PT2_1 is illustrated as being provided on the short side surface of the nozzle plate NP_1, but embodiments are not limited thereto. For example, the protrusion PT1_1 or PT2_1 may be disposed on the long side surface of the nozzle plate NP_1. In addition, a plurality of protrusions PT1_1 and PT2_1 may be provided on one nozzle plate NP_1.

The width of the protrusion PT1_1 or PT2_1 may be smaller than the width of the side surface on which the protrusion PT1_1 or PT2_1 is disposed. Further, the thickness of the protrusion PT1_1 or PT2_1 may be the same as the thickness of the nozzle plate NP_1 that is physically connected to the protrusion PT1_1 or PT2_1, but embodiments are not limited thereto. For example, the thickness of the protrusion PT1_1 or PT2_1 may be smaller than the thickness of the nozzle plate NP_1. Each of the protrusions PT1_1 and PT2_1 may not overlap in the thickness direction (e.g., in the vertical direction) so as to be easily gripped.

In an embodiment, a second nozzle plate NP2_1 may include a first protrusion PT1_1, and a third nozzle plate NP3_1 may include a second protrusion PT2_1. The first protrusion PT1_1 may cover a portion of one side surface of the second nozzle plate NP2_1, and the second protrusion PT2_1 may cover a portion of one side of the third nozzle plate NP3_1.

The inkjet printing apparatus 1000_1 according to the embodiment may include a plurality of nozzle plates NP_1 having a stacked structure, and each of the nozzle plates NP_1 may be easily detached or separated. Accordingly, when a specific nozzle NZ_1 has a problem, only the nozzle plate NP_1 including the specific nozzle NZ_1 among the plurality of nozzle plates NP_1 may be removed or detached, thereby reducing the cost of replacing a head unit 700_1. Further, the replacement time of the head unit 700_1 may be shortened, thereby improving production efficiency of the inkjet printing apparatus 1000_1.

Figure 19:
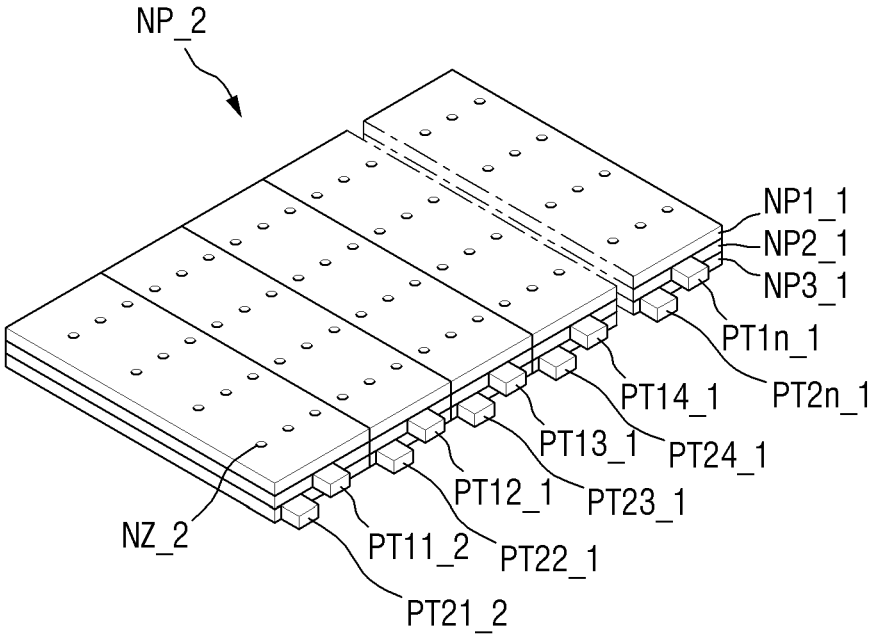
FIG. 19 is a perspective view of another embodiment of the nozzle plate of the head unit of the inkjet printing apparatus of FIG. 8.

FIG. 19 is a perspective view showing a nozzle plate according to still another embodiment.

An inkjet printing apparatus 1000_2 according to the embodiment may include a nozzle plate NP_2 divided by regions. Specifically, the nozzle plate NP_2 according to the embodiment may be divided into a plurality of sub-nozzle plates arranged along a long side of the nozzle plate NP_2. The number of the sub-nozzle plates included in one nozzle plate NP_2 is two or more, and may be less than or equal to the number of nozzles NZ_2 disposed along the long side of the one nozzle plate NP_2. Protrusions PT_2 (e.g., PT11_2, PT12_2, PT13_2, . . . , PT1*n*_2, and PT21_2, PT22_2, PT23_2, . . . , PT2*n*_2) may be disposed on the short side surfaces of the sub-nozzle plates of a second nozzle plate NP2_2 and the sub-nozzle plates of a third nozzle plate NP3_2.

The inkjet printing apparatus 1000_2 according to the embodiment may include a plurality of nozzle plates NP_2 having a stacked structure, and each of the nozzle plates NP_2 may be easily detached or separated. Accordingly, when a specific the nozzle NZ_2 has a problem, only the sub-nozzle plate of the nozzle plate NP_2 including the specific nozzle NZ_2 among the plurality of nozzle plates NP_2 may be removed or detached, thereby reducing the cost of replacing a head unit 700_2. Further, the replacement time of the head unit 700_2 may be shortened, thereby improving production efficiency of the inkjet printing apparatus 1000_2.

Figure 20:
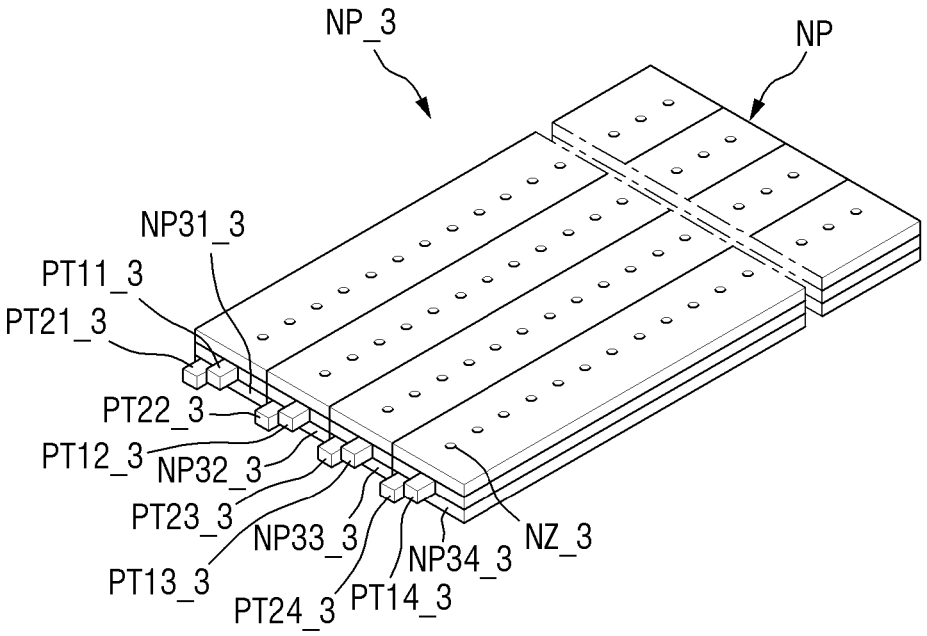
FIG. 20 is a perspective view of another embodiment of the nozzle plate of the head unit of the inkjet printing apparatus of FIG. 8.

FIG. 20 is a perspective view showing a nozzle plate according to still another embodiment.

Referring to FIG. 20, an inkjet printing apparatus 1000_3 according to the embodiment may include a nozzle plate NP_3 divided by regions. Specifically, the nozzle plate NP_3 according to the embodiment may be divided into a plurality of sub-nozzle plates arranged along the short side of the nozzle plate NP_3. The number of the sub-nozzle plates included in one nozzle plate NP_3 is two or more, and may be less than or equal to the number of nozzles NZ _3 disposed along the short side of the nozzle plate NP_3. The nozzle plate NP_3 according to an embodiment may include four sub-nozzle plates, but embodiments are not limited to the number of the sub-nozzle plates. Protrusions PT_3 (e.g., PT11_3, PT12_3, PT13_3, PT14_3, PT21_3, PT22_3, PT23_3, and PT24_3) may be disposed on the short side surfaces of the sub-nozzle plates of a second nozzle plate NP2_3 and the sub-nozzle plates of a third nozzle plate NP3_3.

The inkjet printing apparatus 1000_3 according to the embodiment may include a plurality of nozzle plates NP_3 having a stacked structure, and each of the nozzle plates NP_3 may be easily detached or separated. Accordingly, when a specific nozzle NZ_3 has a problem, only the nozzle plate NP_3 including the specific nozzle NZ_3 among the plurality of nozzle plates NP_3 may be removed, thereby reducing the cost of replacing a head unit 700_3. Further, the replacement time of the head unit 700_3 may be shortened, thereby improving production efficiency of the inkjet printing apparatus 1000_3.

Figure 21:
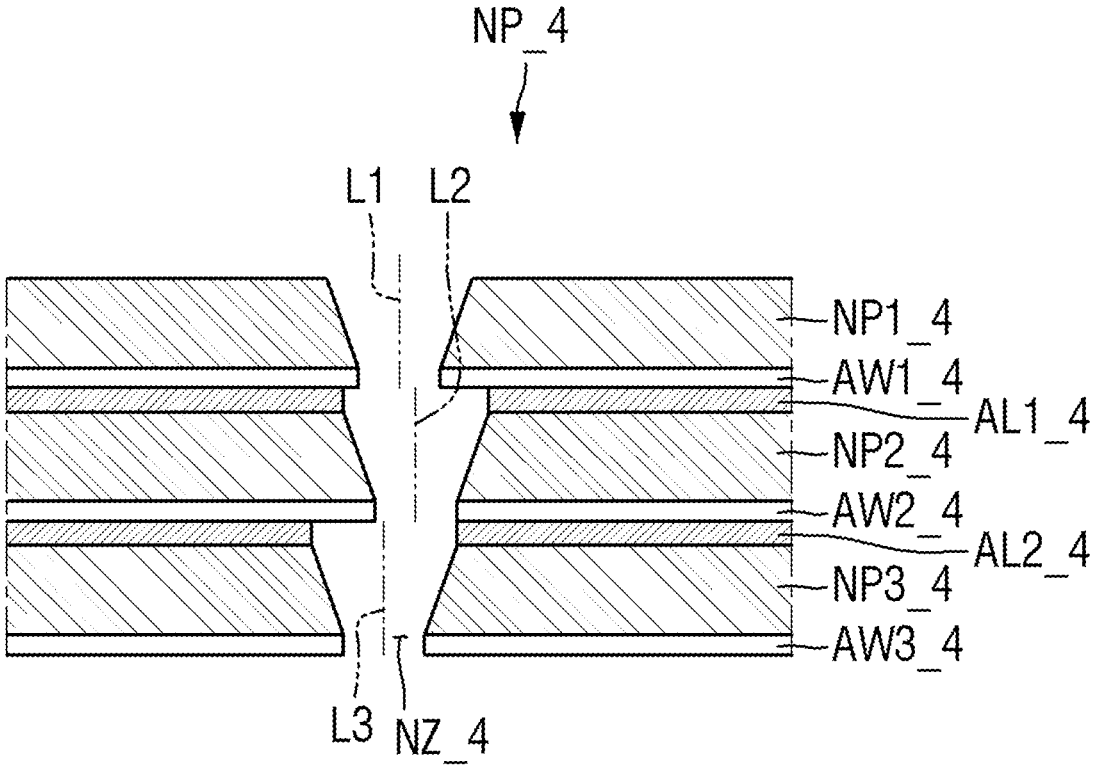
FIG. 21 is a cross-sectional view of another embodiment of the nozzle plate of the head unit of the inkjet printing apparatus of FIG. 8.

FIG. 21 is a cross-sectional view of a nozzle of a nozzle plate according to still another embodiment.

In an inkjet printing apparatus 1000_4 according to the embodiment, through holes formed in nozzle plates NP_4 may not be aligned. Specifically, a first imaginary line L1 passing through the center of the through hole included in a first nozzle plate NP1_4, a second imaginary line L2 passing through the center of the through hole included in a second nozzle plate NP2_4, and a third imaginary line L3 passing through the center of the through hole included in a third nozzle plate NP3_4 may not be aligned. The ink ejected from the inkjet printing apparatus 1000_4 according to the embodiment may be ejected mostly along the first, second, and third imaginary lines L1, L2, and L3.

The inkjet printing apparatus 1000_4 according to the embodiment may include a plurality of nozzle plates NP_4 having a stacked structure, and each of the nozzle plates NP_4 may be easily detached or separated. Accordingly, when a specific nozzle NZ_4 has a problem, only the nozzle plate NP_4 including the specific nozzle NZ_4 among the plurality of nozzle plates NP_4 may be removed or detached, thereby reducing the cost of replacing a head unit 700_4. Further, the replacement time of the head unit 700_4 may be shortened, thereby improving production efficiency of the inkjet printing apparatus 1000_4.

Figure 22:
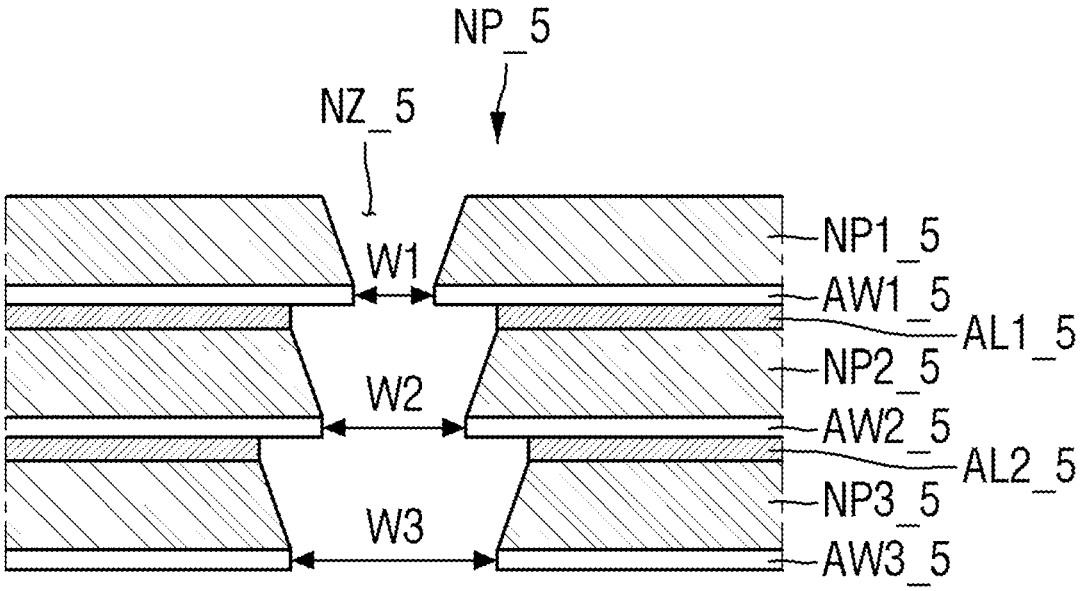
FIG. 22 is a cross-sectional view of another embodiment of the nozzle plate of the head unit of the inkjet printing apparatus of FIG. 8.

FIG. 22 is a cross-sectional view of a nozzle of a nozzle plate according to still another embodiment.

In an inkjet printing apparatus 1000_5 according to the embodiment, through holes formed in nozzle plates NP_5 may have different widths (e.g., diameters) from each other. Specifically, a first width W1, which is the width of the through hole included in a first nozzle plate NP1_5, a second width W2, which is the width of the through hole included in a second nozzle plate NP2_5, and a third width W3, which is the width of the through hole included in a third nozzle plate NP3_5, may be different from each other.

In an embodiment, in the nozzle plates NP_5 having a stacked structure, the width of a nozzle NZ_5 may increase downward. For example, the second width W2 may be greater than the first width W1, and the third width W3 may be greater than the second width W2, but embodiments are not limited thereto. When the width increases downward, the influence of the nozzle NZ_5 received by the ejected ink may be minimized.

The inkjet printing apparatus 1000_5 according to the embodiment may include a plurality of nozzle plates NP_5 having a stacked structure, and each of the nozzle plates NP_5 may be easily detached or separated. Accordingly, when a specific nozzle NZ_5 has a problem, only the nozzle plate NP_5 including the specific nozzle NZ_5 among the plurality of nozzle plates NP_5 may be removed or detached, thereby reducing the cost of replacing a head unit 700_5. Further, the replacement time of the head unit 700_5 may be shortened, thereby improving production efficiency of the inkjet printing apparatus 1000_5.

Figure 23:
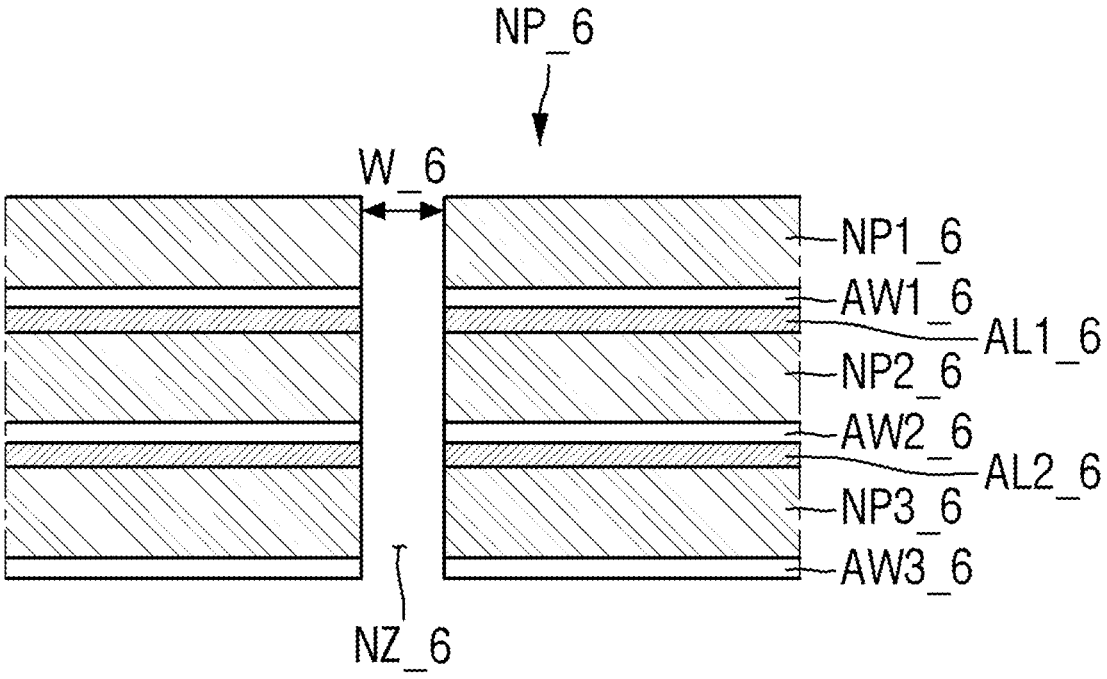
FIG. 23 is a cross-sectional view of another embodiment of the nozzle plate of the head unit of the inkjet printing apparatus of FIG. 8.

FIG. 23 is a cross-sectional view of a nozzle of a nozzle plate according to still another embodiment.

In an inkjet printing apparatus 1000_6 according to the embodiment, the widths (e.g., diameters) of through holes formed in nozzle plates NP1_6, NP2_6, and NP3_6 are substantially constant, so that a width W_6 of a nozzle NZ_6 formed in the nozzle plates NP_6 may be substantially constant throughout the nozzle plates NP_6. The width of the through hole included in a first nozzle plate NP1_6, the width of the through hole included in a second nozzle plate NP2_6, and the width of the through hole included in a third nozzle plate NP3_6 may be the same as each other.

The inkjet printing apparatus 1000_6 according to the embodiment may include a plurality of nozzle plates NP_6 having a stacked structure, and each of the nozzle plates NP_6 may be easily detached. Accordingly, when a specific nozzle NZ_6 has a problem, only the nozzle plate NP_6 including the specific nozzle NZ_6 among the plurality of nozzle plates NP_6 may be removed, thereby reducing the cost of replacing a head unit 700_6. Further, the replacement time of the head unit 700_6 may be shortened, thereby improving production efficiency of the inkjet printing apparatus 1000_6.

In concluding the detailed description, those skilled in the art will appreciate that many variations and modifications can be made to the preferred embodiments without substantially departing from the principles of the present invention. Therefore, the disclosed preferred embodiments of the invention are used in a generic and descriptive sense only and not for purposes of limitation.

What is claimed is:

1. An inkjet printing apparatus comprising:
a passage plate in which a head chamber is disposed;
a plurality of nozzle plates disposed below the passage plate, the plurality of nozzle plates comprising a nozzle that is in fluid connection with the head chamber; and
at least one protrusion extending outwardly from at least one of the plurality of nozzle plates, wherein:
the plurality of nozzle plates are stacked on each other, and
the nozzle of the plurality of nozzle plates comprises a plurality of through holes passing through the plurality of nozzle plates and overlapping each other.

2. The inkjet printing apparatus of claim 1, wherein the at least one protrusion extends outwardly from a side surface of at least one of the plurality of nozzle plates.

3. The inkjet printing apparatus of claim 1, wherein a water repellent layer is disposed on a bottom surface of each of the plurality of nozzle plates.

4. The inkjet printing apparatus of claim 3, wherein an adhesive layer is disposed between the water repellent layer and the plurality of nozzle plates.

5. The inkjet printing apparatus of claim 4, wherein an adhesive strength between the adhesive layer and an upper surface of each of the plurality of nozzle plates is greater than an adhesive strength between the adhesive layer and the water repellent layer.

6. The inkjet printing apparatus of claim 1, wherein each of the plurality of through holes of the plurality of nozzle plates comprises an upper inner side surface having a first width and a lower inner side surface having a second width smaller than the first width.

7. The inkjet printing apparatus of claim 6, wherein:
the plurality of nozzle plates comprise a first nozzle plate and a second nozzle plate disposed on the first nozzle plate, and
the first width of the through hole of the first nozzle plate is greater than the first width of the through hole of the second nozzle plate.

8. The inkjet printing apparatus of claim 1, wherein the plurality of nozzle plates comprises:
a first nozzle plate; and
a second nozzle plate disposed on the first nozzle plate.

9. The inkjet printing apparatus of claim 8, wherein the second nozzle plate comprises a protrusion extending from a side surface of the second nozzle plate more outwardly than the first nozzle plate.

10. An inkjet printing apparatus comprising:
a passage plate in which a head chamber is disposed; and
a plurality of nozzle plates disposed below the passage plate, the plurality of nozzle plates comprising a nozzle that is in fluid connection with the head chamber
wherein:
the plurality of nozzle plates are stacked on each other, and
the nozzle of the plurality of nozzle plates comprises a plurality of through holes passing through the plurality of nozzle plates and overlapping each other,
wherein the plurality of nozzle plates comprises:
a first nozzle plate; and
a second nozzle plate disposed on the first nozzle plate,
wherein a first water repellent layer is disposed on a bottom surface of the first nozzle plate, and a second water repellent layer is disposed on a bottom surface of the second nozzle plate.

11. The inkjet printing apparatus of claim 10, wherein an adhesive layer is disposed between the second water repellent layer and the first nozzle plate.

12. The inkjet printing apparatus of claim 11, wherein an adhesive strength between the first nozzle plate and the adhesive layer is greater than an adhesive strength between the second water repellent layer and the adhesive layer.

13. The inkjet printing apparatus of claim 8, wherein a width of an inner side surface of the through hole of the first nozzle plate is greater than a width of an inner side surface of the through hole of the second nozzle plate.

14. The inkjet printing apparatus of claim 1, further comprising:
a membrane disposed on the passage plate; and
a piezoelectric driver disposed on the membrane and configured to change a volume of the piezoelectric driver according to an input signal,
wherein the piezoelectric driver is configured to deform the membrane.

15. The inkjet printing apparatus of claim 14, wherein the piezoelectric driver is configured to change a volume of the head chamber.

16. An inkjet printing apparatus comprising:
a passage plate in which a head chamber is disposed; and
a plurality of nozzle plates disposed below the passage plate, the plurality of nozzle plates comprising a nozzle that is in fluid connection with the head chamber
wherein:
the plurality of nozzle plates are stacked on each other, and
the nozzle of the plurality of nozzle plates comprises a plurality of through holes passing through the plurality of nozzle plates and overlapping each other,
wherein each of the plurality of nozzle plates comprises a plurality of sub-nozzle plates arranged in one direction.

17. The inkjet printing apparatus of claim 16, wherein each of the plurality of sub-nozzle plates comprises a protrusion extending outwardly from a side surface of each of the plurality of sub-nozzle plates.

18. An inkjet printing method comprising the steps of:
spraying ink using an inkjet printing apparatus comprising a plurality of nozzle plates, the plurality of nozzle plates comprising a plurality of through holes overlapping each other;

determining whether a pattern of the sprayed ink is defective;

removing an outermost nozzle plate among the plurality of nozzle plates when the sprayed ink pattern is defective; and spraying ink using remaining nozzle plates through the through holes of the remaining nozzle plates.

19. The inkjet printing method of claim 18, wherein each of the plurality of nozzle plates comprises a protrusion extending outwardly from a side surface of each of the plurality of nozzle plates, and the step of removing the outermost nozzle plate comprises the step of detaching the outermost nozzle plate by gripping the protrusion thereof.

20. The inkjet printing method of claim 18, wherein the step of spraying the ink comprises the step of ejecting ink through a nozzle comprising the plurality of through holes overlapping each other.

* * * * *